US006244636B1

(12) United States Patent
Rissone

(10) Patent No.: US 6,244,636 B1
(45) Date of Patent: Jun. 12, 2001

(54) DOOR LATCH

(76) Inventor: Robert Rissone, 134 Norcrest Dr., Rochester, NY (US) 14617

( * ) Notice: Subject to any disclaimer, the term of this patent is extended or adjusted under 35 U.S.C. 154(b) by 0 days.

(21) Appl. No.: 09/362,873

(22) Filed: Jul. 29, 1999

(51) Int. Cl.[7] ..... E05C 3/04

(52) U.S. Cl. ..... 292/202; 292/342; 292/251.5; 16/82

(58) Field of Search ..... 292/202, 203, 292/242, 243, 338, 339, 251.5, 278; 16/82

(56) References Cited

U.S. PATENT DOCUMENTS

| | | | | |
|---|---|---|---|---|
| 217,762 | * | 7/1879 | Witte | 292/339 |
| 308,823 | * | 11/1884 | Bitter | 292/278 |
| 584,950 | * | 6/1897 | Mead | 292/338 |
| 597,895 | * | 1/1898 | Chaplin | 292/278 |
| 966,349 | | 8/1910 | McCullah . | |
| 1,082,019 | * | 12/1913 | Frederick | 292/297 |
| 1,210,826 | | 1/1917 | Minor . | |
| 1,288,988 | | 12/1918 | Reed . | |
| 1,312,931 | | 8/1919 | Tenny et al. . | |
| 1,488,590 | * | 4/1924 | Fellman | 292/338 |
| 1,549,182 | | 8/1925 | Church . | |
| 1,633,645 | | 6/1927 | Molberg . | |
| 1,667,771 | * | 5/1928 | Chiapparelli | 292/128 |
| 2,097,348 | * | 10/1937 | Sladek | 292/338 |
| 2,644,708 | | 7/1953 | Poole . | |
| 2,682,683 | * | 7/1954 | Padula | 292/338 |
| 3,172,168 | * | 3/1965 | Suska | 292/219 |
| 3,276,804 | * | 10/1966 | Heppner | 292/251.5 |
| 3,980,330 | | 9/1976 | Walker . | |
| 4,015,867 | * | 4/1977 | Siden | 292/262 |
| 4,027,907 | | 6/1977 | Crepinsek . | |
| 4,027,908 | | 6/1977 | Crepinsek . | |
| 4,099,754 | | 7/1978 | Hoebing . | |
| 4,226,453 | | 10/1980 | Robertson . | |
| 4,575,140 | | 3/1986 | Dargis . | |
| 4,871,203 | | 10/1989 | Rogers . | |
| 4,979,769 | * | 12/1990 | Salyer | 292/338 |
| 4,982,474 | * | 1/1991 | Kjellstrom | 16/82 |
| 5,360,245 | | 11/1994 | David et al. . | |
| 5,462,319 | | 10/1995 | Roden, Jr. . | |
| 5,465,460 | * | 11/1995 | Cantone | 16/82 |
| 5,590,922 | * | 1/1997 | Hucknall | 292/300 |
| 5,772,265 | | 6/1998 | Gilbert . | |
| 5,890,751 | * | 4/1999 | Seffinga | 292/67 |
| 5,901,590 | | 5/1999 | Lai . | |
| 5,909,919 | | 6/1999 | Wang . | |
| 6,058,563 | * | 5/2000 | Bucknell | 16/82 |

* cited by examiner

*Primary Examiner*—Gary W. Estremsky
(74) *Attorney, Agent, or Firm*—Nixon & Vanderhye P.C.

(57) ABSTRACT

A door latch assembly for preventing unwanted entry into a hotel room, apartment, dwelling, or the like. In certain embodiments, the door latch assembly includes an approximately L-shaped member which is selectively pivoted between locking and non-locking positions. In certain embodiments, the latch may not be readily utilized to prop open a door, as a closing door will cause the latch to move from a locking position to a non-locking position during door closure.

10 Claims, 19 Drawing Sheets

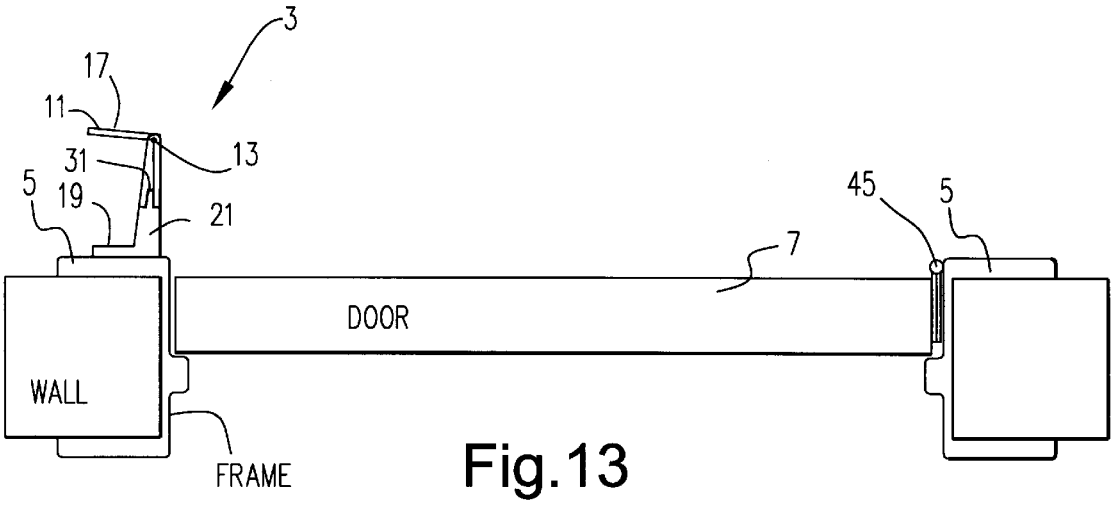
Fig.13
Fig.14
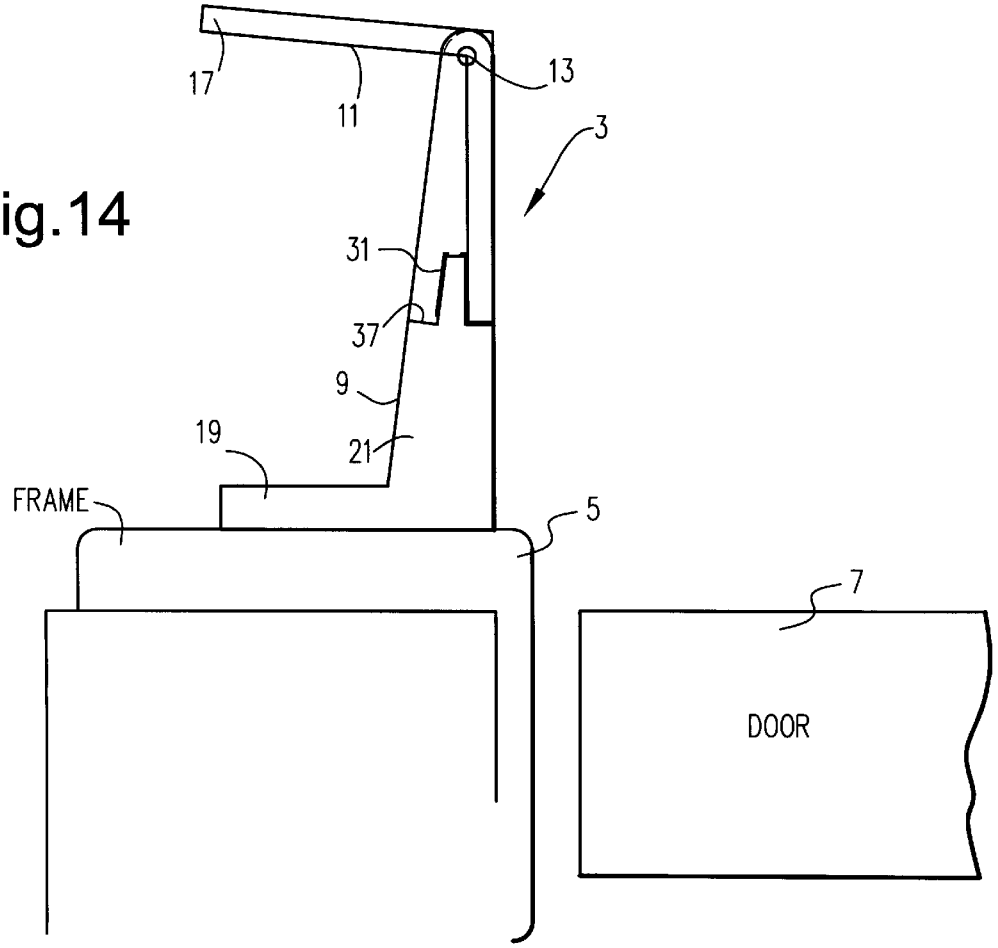

DOOR LATCH

This invention relates to a door latch apparatus. More particularly, this invention relates to a door latch apparatus capable of being pivoted or moved between locking and non-locking positions.

BACKGROUND OF THE INVENTION

Various apparatuses have been known to secure an inwardly swinging door in a closed position when an occupant of a room/dwelling is within the room/dwelling. Devices of this type include a slide bolt mounted on the inner surface of the door having an end which slides into a keeper mounted on the door frame. Also, conventional chain locks have been employed in apartments, hotel rooms, and the like. Such chain locks typically extend between the door and the adjacent door frame.

Unfortunately, conventional chain lock devices may be overcome by intruders who have access to or are carrying bolt cutters, chain cutters, or the like. Thus, hotel rooms and apartments including such chain locks have been susceptible to undesirable entry.

Another conventional apparatus typically utilized in hotel rooms comprises a latch swingable between locking and non-locking positions. Unfortunately, such devices suffer from numerous problems. For example, when one leaves a hotel room to get ice or a soda, one may often open the door, swing the latch into the doorway, and then allow the door to swing toward a closed position so that the latch keeps the door open while one is outside of the room. Such use can lead to door damage, intruders entering the room, latch damage, and the like.

Other door securing devices are set forth in, for example, U.S. Pat. Nos. 4,027,908; 4,575,140; 5,360,245; and 5,462,319, the disclosures of which are all hereby incorporated herein by reference.

It is apparent from the above that there exists a need in the art for a door latch apparatus which is efficiently movable between locking and non-locking positions. There also exists a need in the art for a door latch device which cannot readily be used to prop open a door when the occupant leaves the room. Still further, there exists a need in the art for a door latch device which is efficient, simple, and/or not costly to manufacture.

It is a purpose of this invention to fulfill any or all of the above-described needs in the art, as well as other needs which will become apparent to the skilled artisan from the following detailed description of this invention.

SUMMARY OF THE INVENTION

An object of this invention is to provide a door latch apparatus which is easily moved between locking and non-locking positions.

Another object of this invention is to provide a door latch apparatus which is efficient and not particularly costly to manufacture.

Another object of this invention is to provide a door latch apparatus which is not easily useable to prop open hotel or apartment doors when the occupant is outside of the room/dwelling.

Another object of this invention is to provide a door latch apparatus which effectively locks a door against unwanted entry when the occupant is within the hotel or dwelling.

Another object of this invention is to provide a door latch which prevents the door from fully opening, yet still allows the door to be opened a crack so as to allow one within a hotel room or the like to talk to someone outside the door without letting them enter the room.

Another object of this invention is to provide a door latch which will retract out of the door opening when someone tries to use it to hold the door open.

Another object of this invention is to provide a special tool for unlocking such a door latch from outside of the room, in emergency situations when necessary.

Another object of this invention is to fulfill any and/or all of the above-listed objects.

This invention will now be described with respect to certain embodiments thereof, along with reference to the accompanying illustrations.

IN THE DRAWINGS

Figure 9:
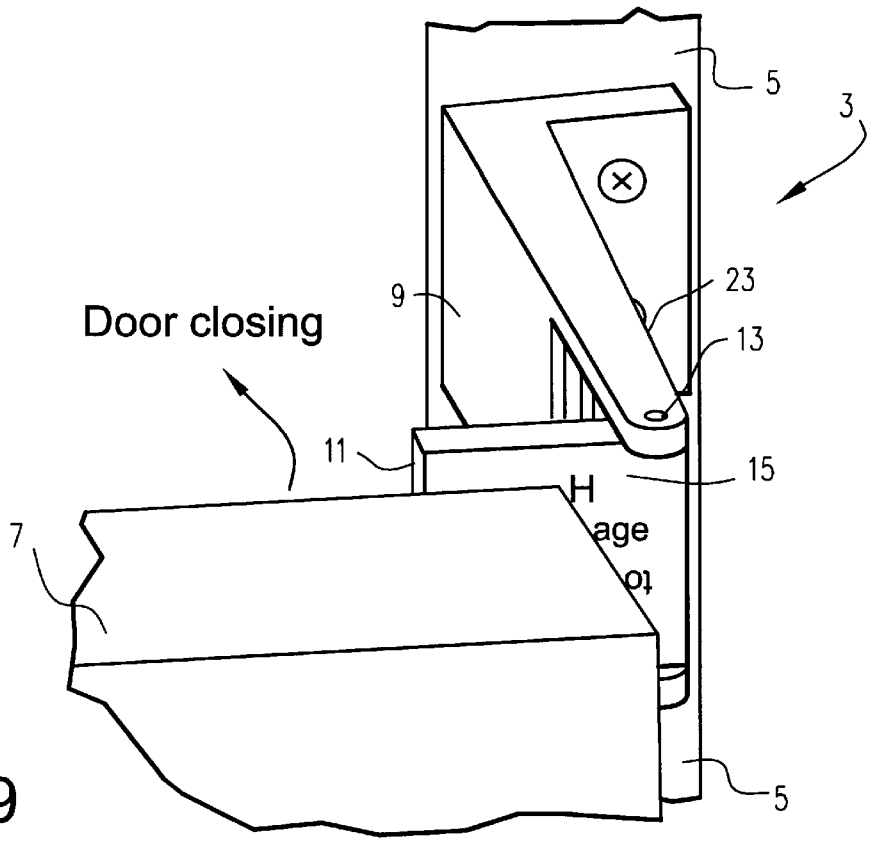
FIG. 9 is a perspective view illustrating a door closing when the latch of FIGS. 1–5 and 7–8 is in a locking or engaged position.
Figure 10:
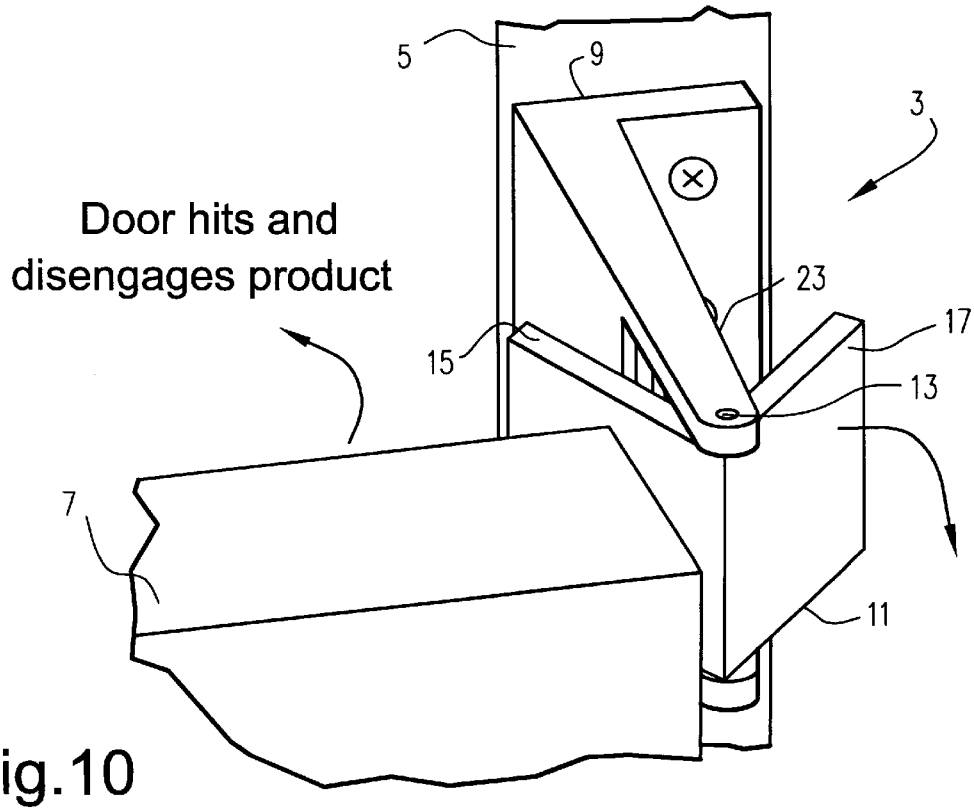
FIG. 10 is a perspective view illustrating the door of FIG. 9 closing and thereby moving the latch from a locking to a non-locking position during the door closing process.
Figure 11A:
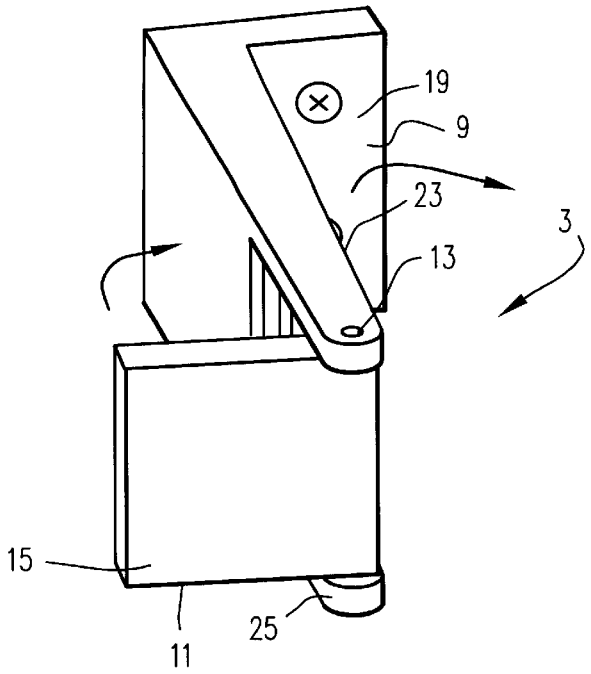
Figure 11B:
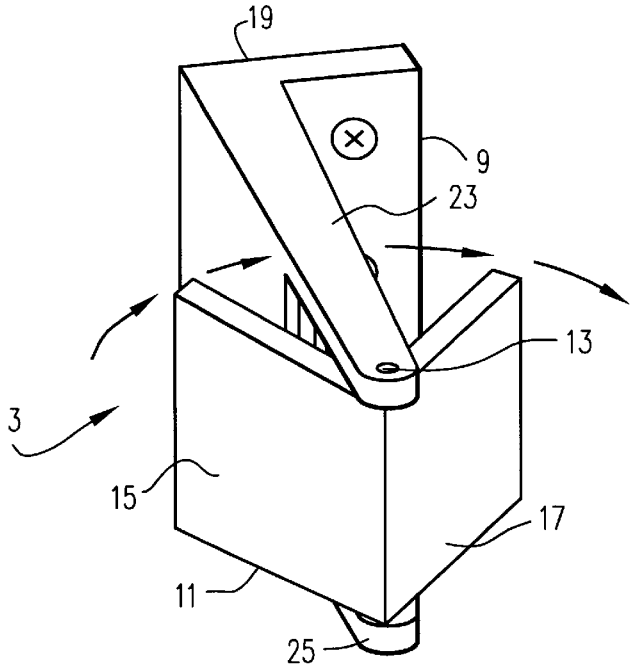
Figure 11C:
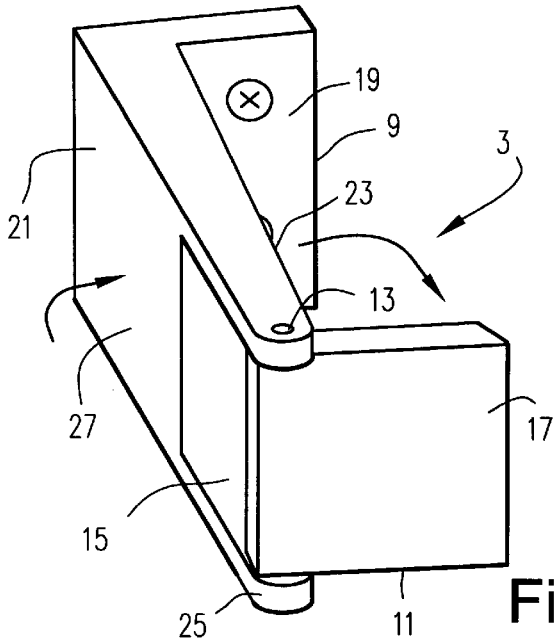

FIGS. 11(*a*)–11(*c*) are perspective views illustrating steps taken when the latch of FIGS. 1–5 and 7–10 is moved from a locking toward a non-locking position.

Figure 12A:
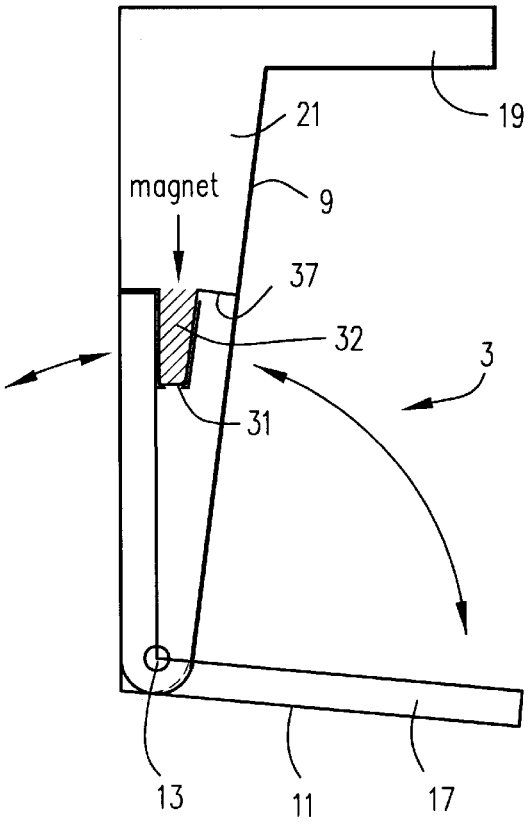
Figure 12B:
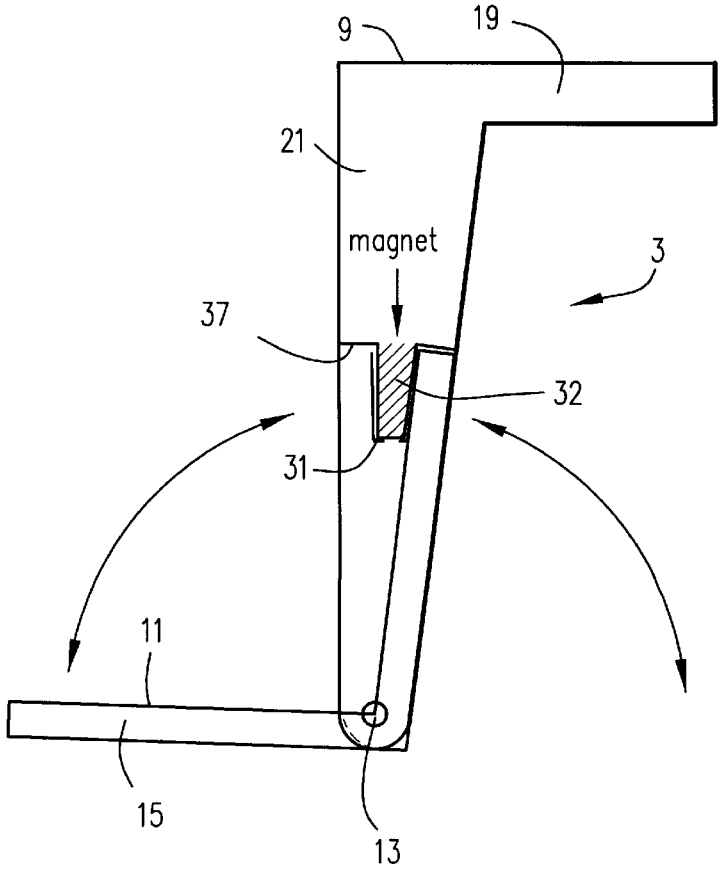

FIG. 12(*a*) is a cross-sectional view illustrating the latch of FIGS. 1–5 and 7–11 in a non-locking position, wherein a magnet is illustrated in cross-section within the stop.

FIG. 12(*b*) is a cross-sectional view illustrating the latch of FIG. 12(*a*) in a locking position.

FIG. 13 is a cross-sectional view illustrating the latch of FIGS. 1–5 and 7–12 in a non-locking position, when used in conjunction with a door, door frame, and wall.

FIG. 14 is an enlarged view of the latch of FIG. 13.

Figure 15:
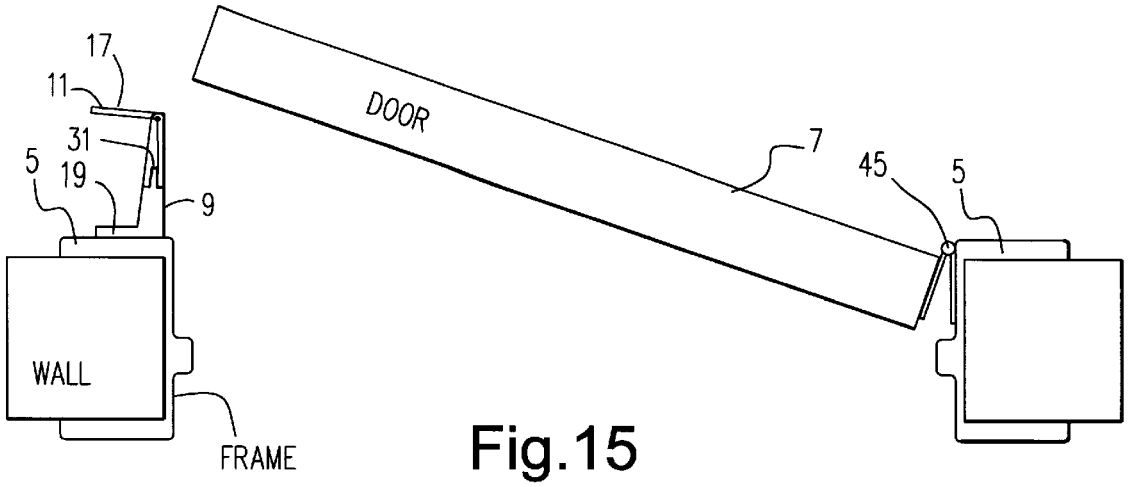

FIG. 15 is a cross-sectional view of the latch of FIGS. 1–5 and 7–14 in a non-locking position so as to enable opening and closing of a door without restraints.

Figure 16:
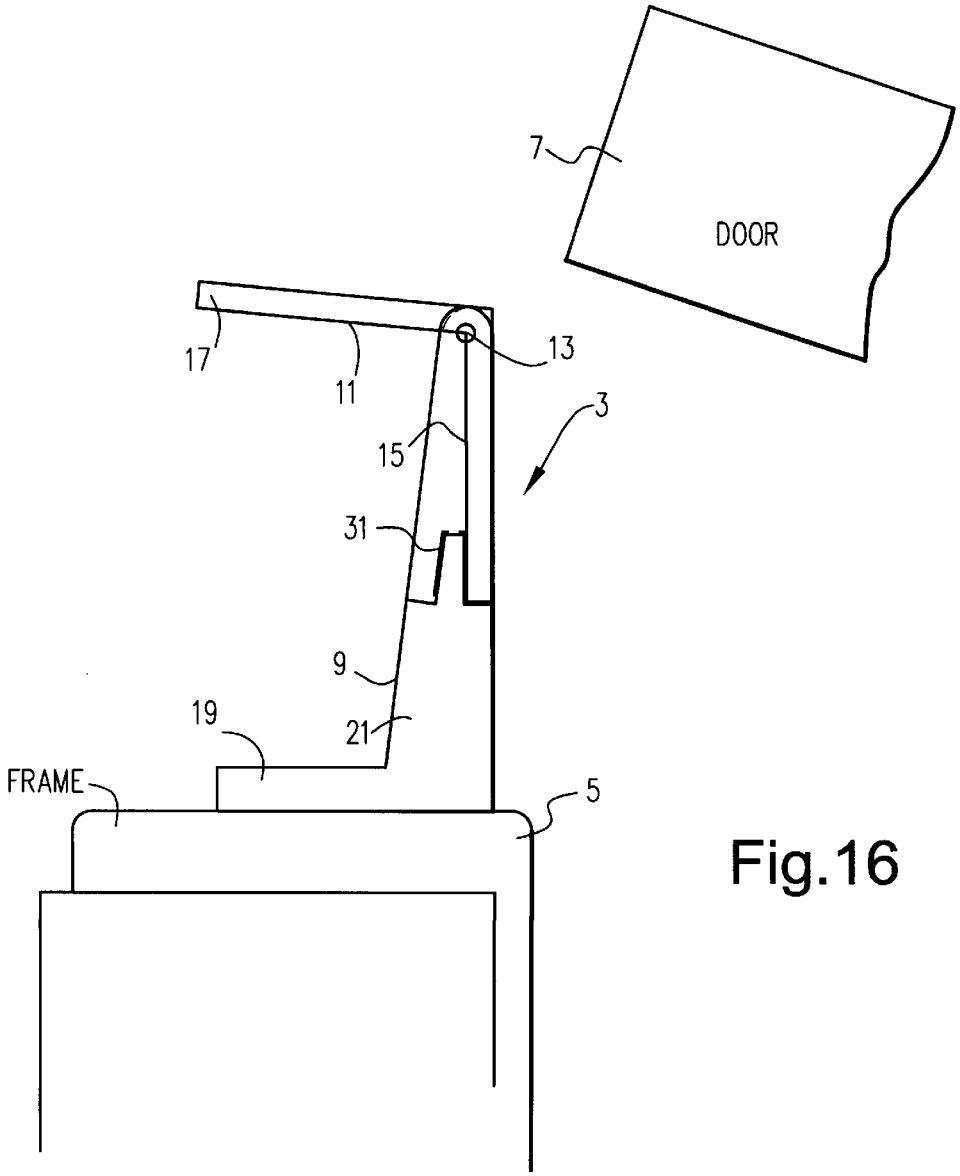

FIG. 16 is an enlarged view of the latch assembly of FIG. 15.

Figure 17:
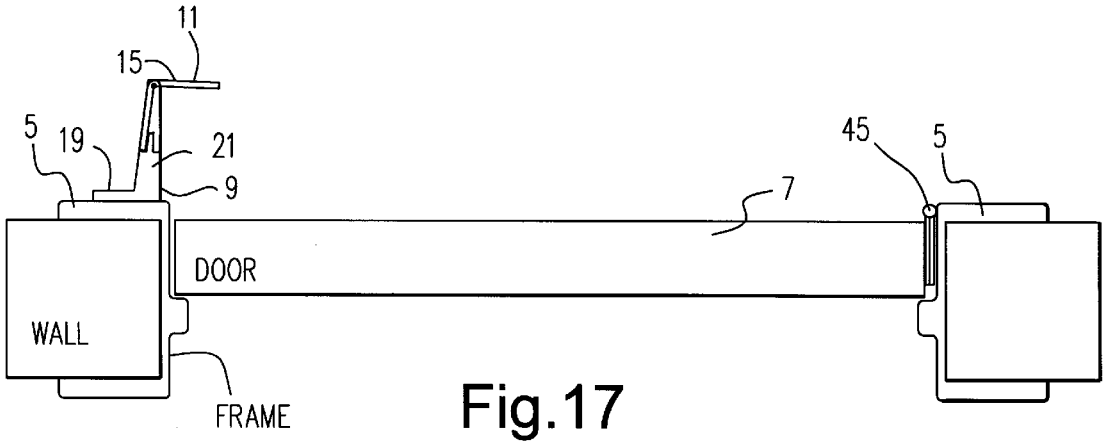

FIG. 17 is a cross-sectional plan view of the latch of FIGS. 15 and 7–16 in a locking position, when used in conjunction with a door, door frame, and wall.

Figure 18:
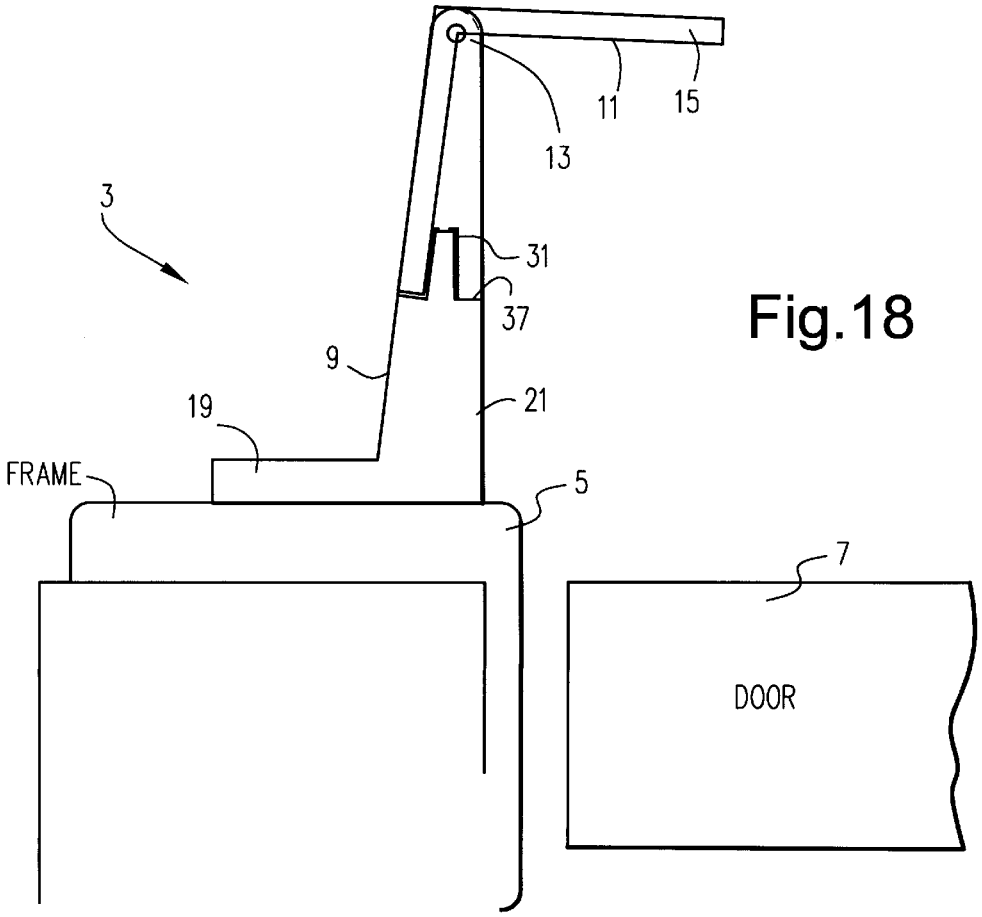

FIG. 18 is an enlarged view of the latch assembly of FIG. 17.

Figure 19:
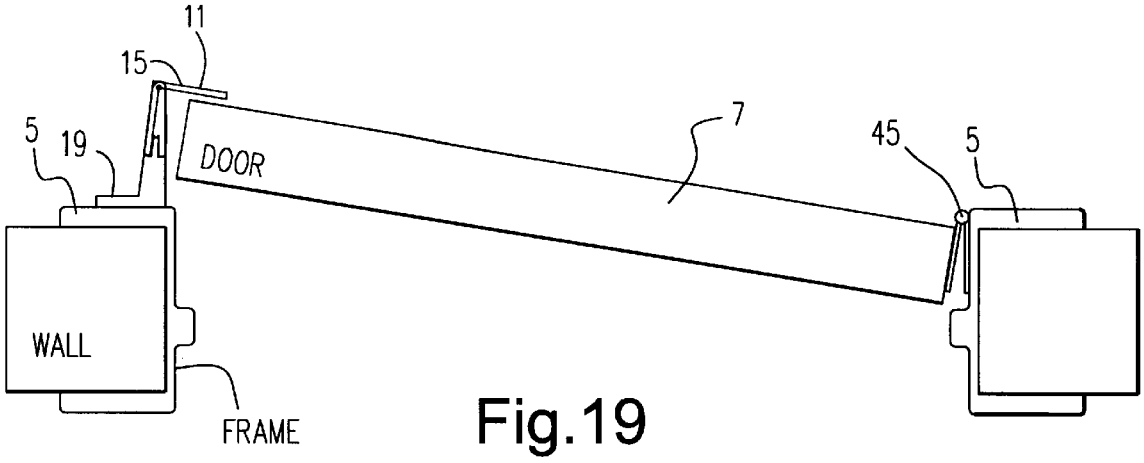

FIG. 19 is a cross-sectional view illustrating the latch of FIGS. 1–5 and 7–18 in a locking position preventing the door from opening more than a small amount.

Figure 20:
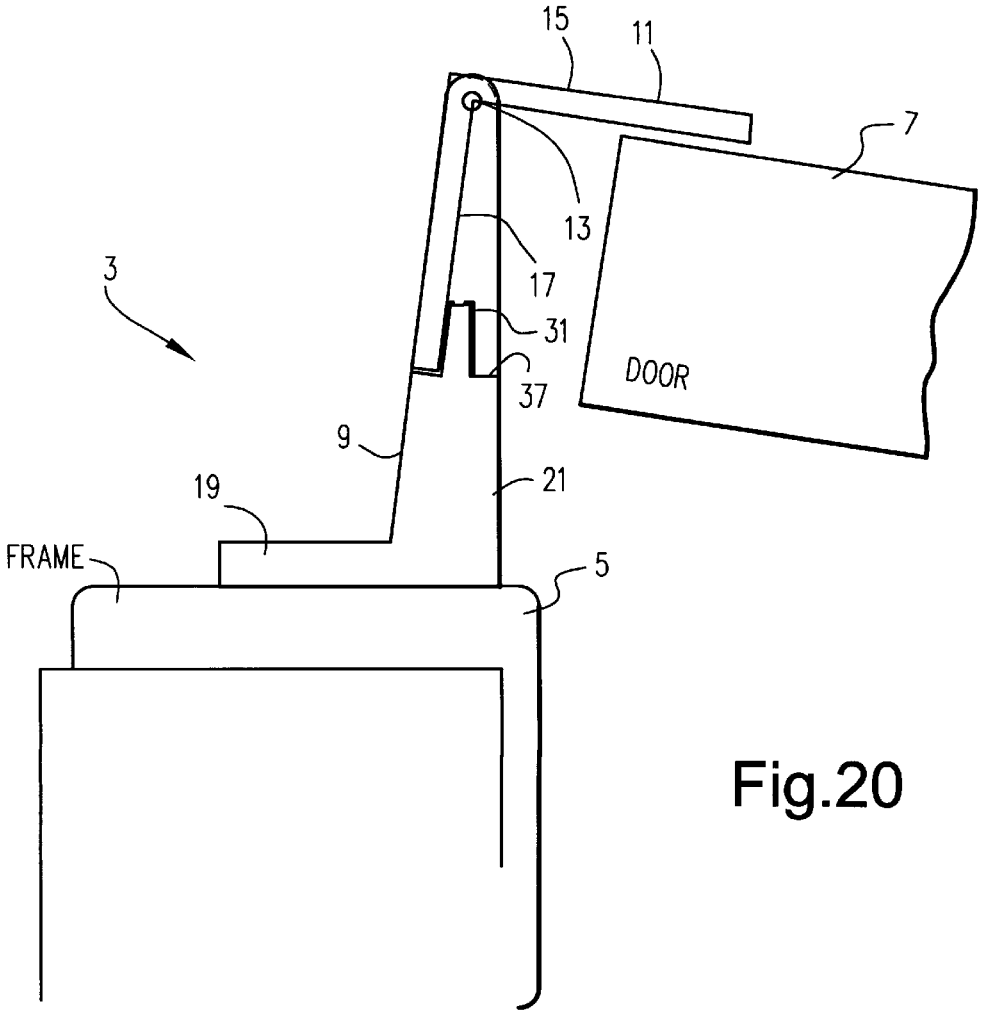
Figure 21A:
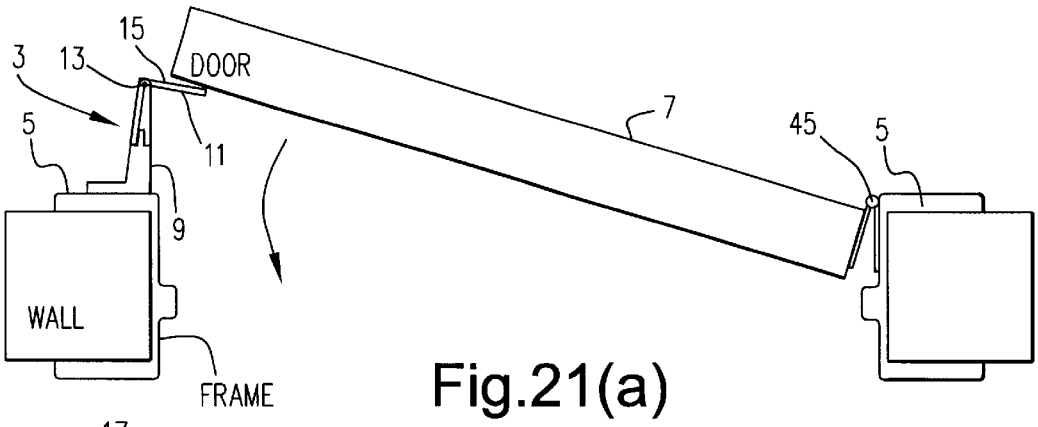
Figure 21B:
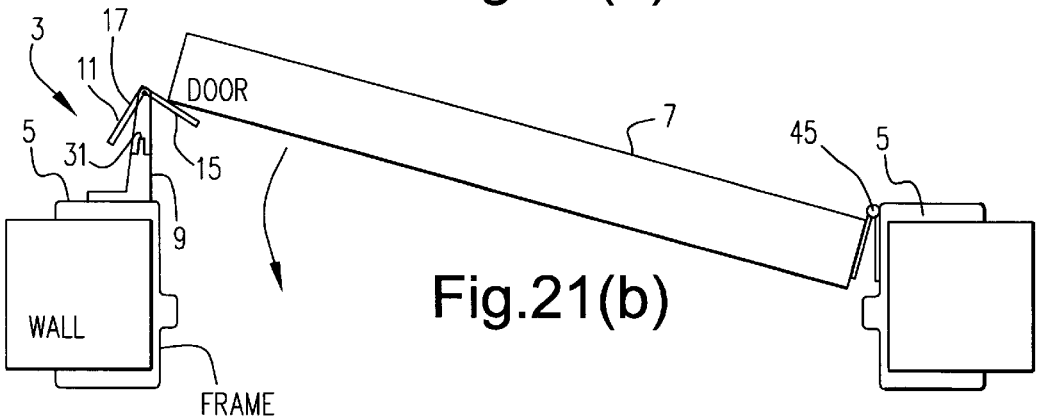
Figure 21C:
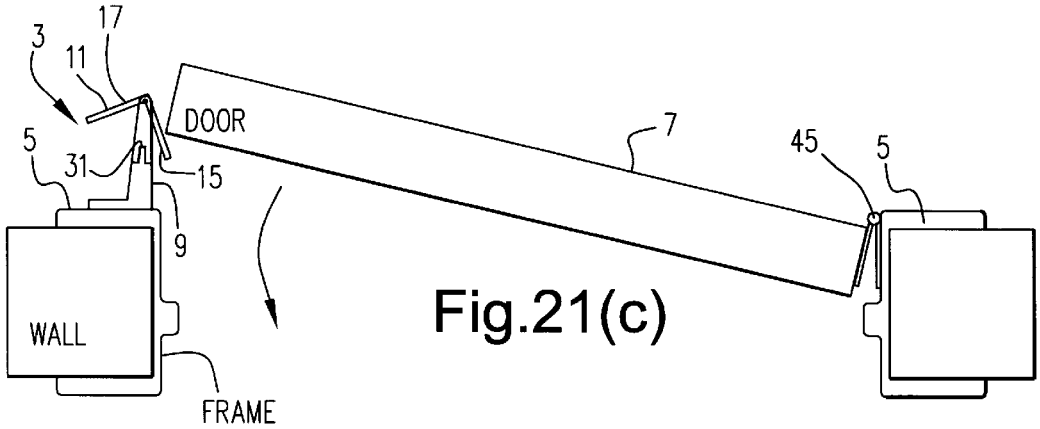
Figure 21D:
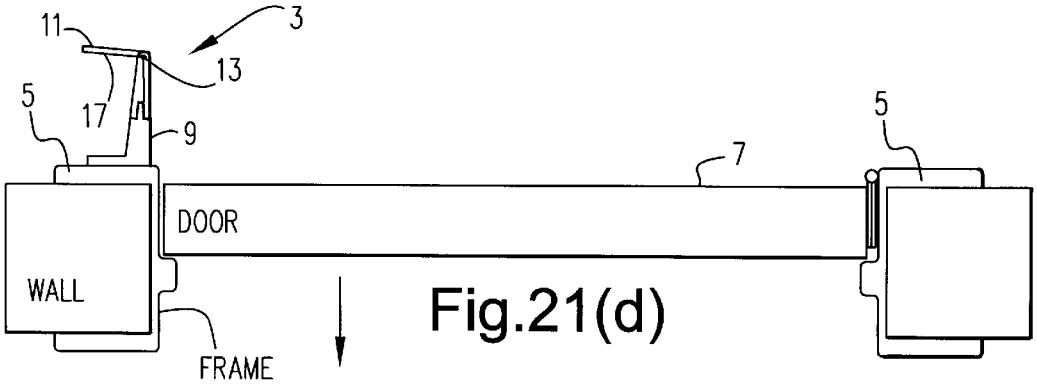

FIG. 20 is an enlarged view of the latch assembly of FIG. 19.

FIGS. 21(*a*)–21(*d*) are cross-sectional views illustrating a door which is closing thereby moving the latch of FIGS. 15 and 7–20 from an engaged or locking position, into a non-locking position during closing of the door.

Figure 22:
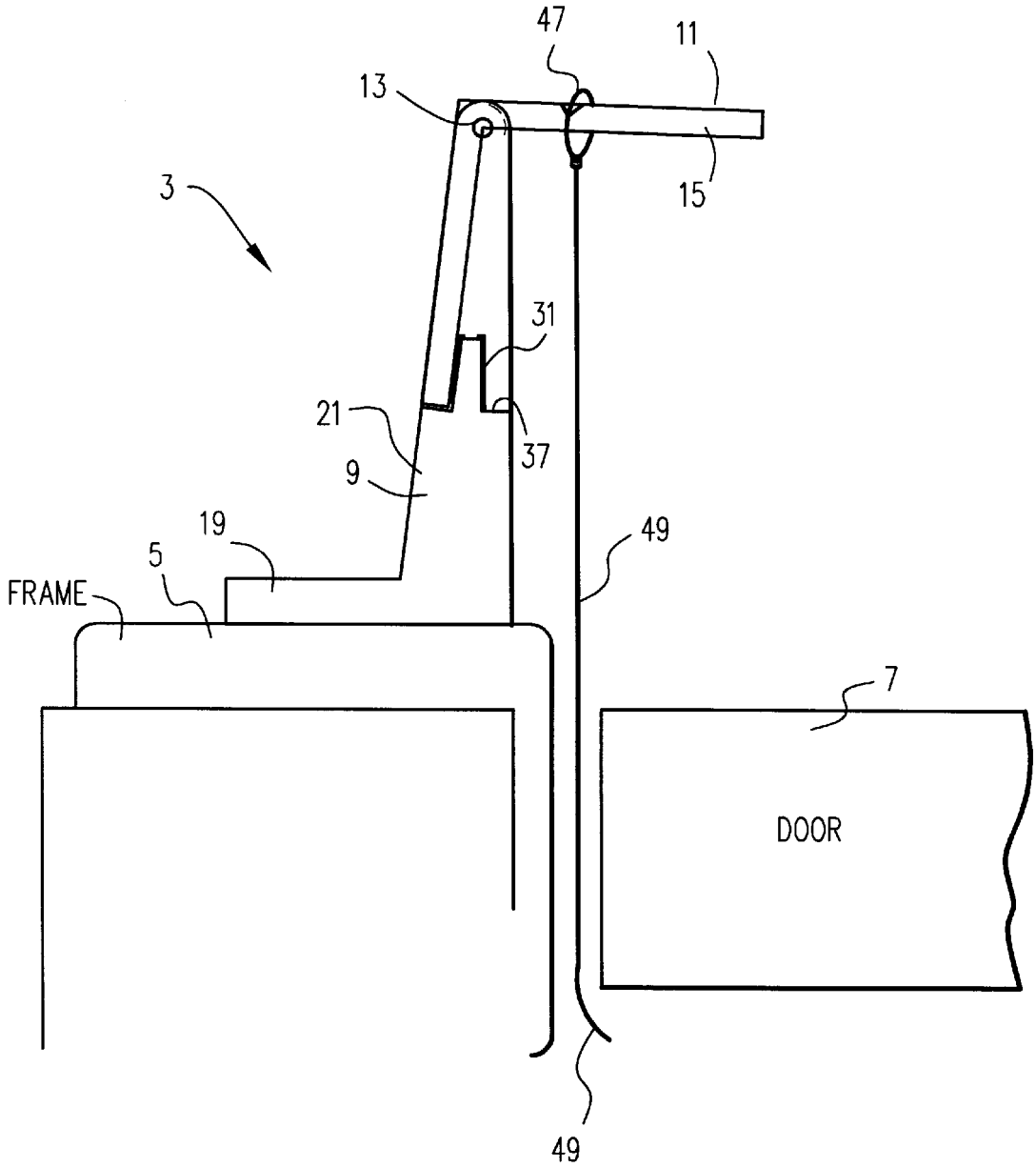

FIG. 22 is a cross-sectional view illustrating how the latch of FIGS. 1–5 and 7–21 may be moved from a locking position toward a non-locking position from outside of the room/door in emergency situations.

Figure 23:
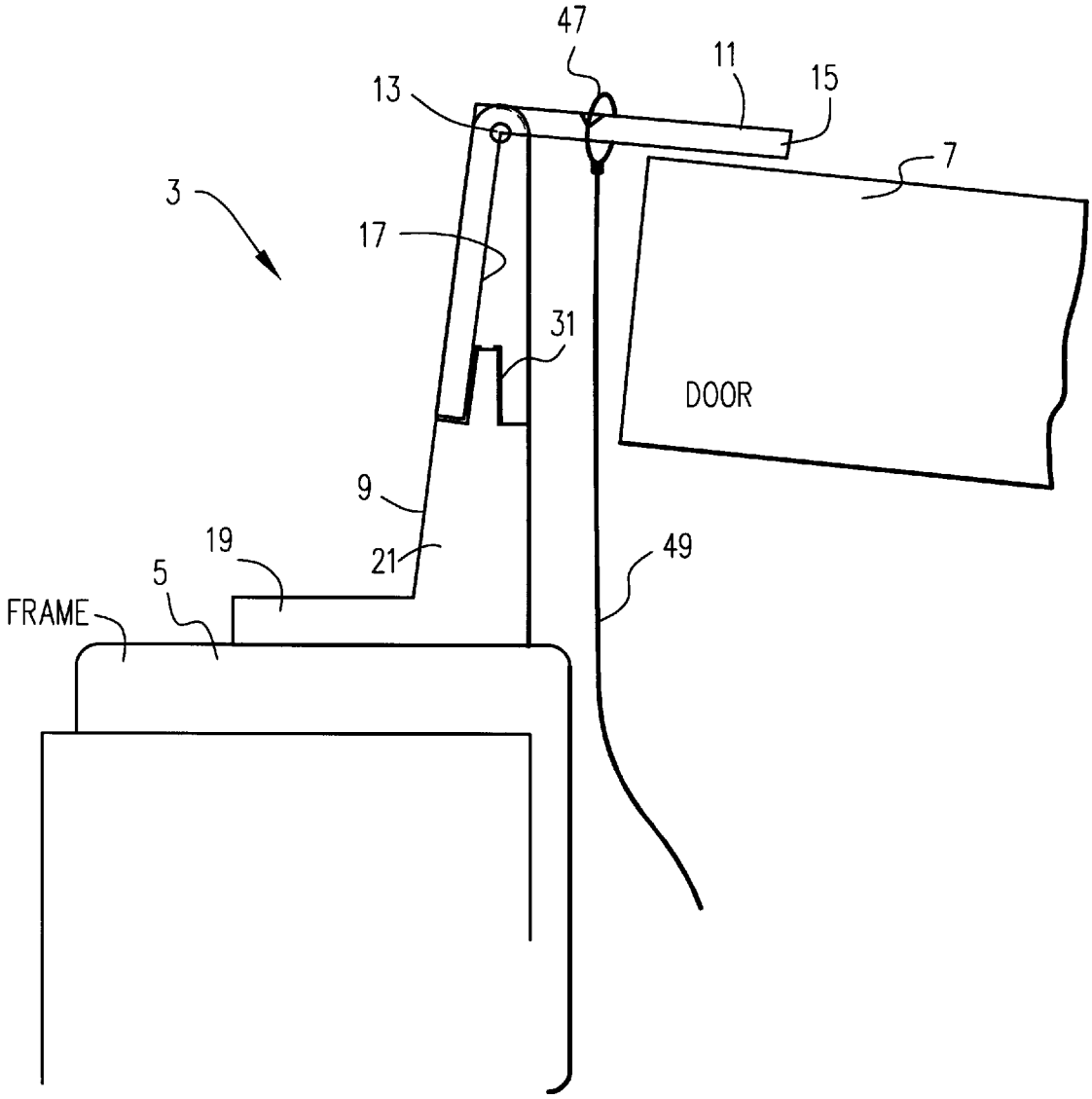

FIG. 23 is an enlarged cross-sectional view of the system of FIG. 22, with the door in a cracked open position.

Figure 24:
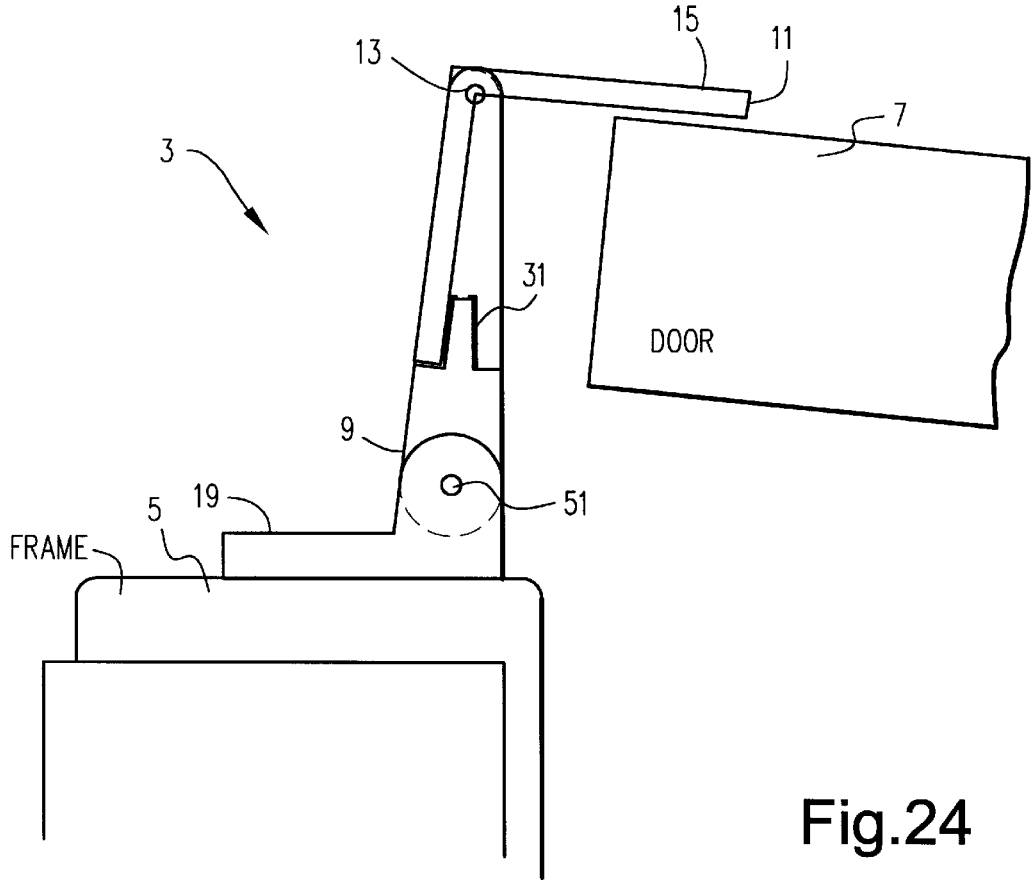

FIG. 24 is a cross-sectional view of a latch assembly according to a second embodiment of this invention, the latch being illustrated in a locking position.

Figure 25:
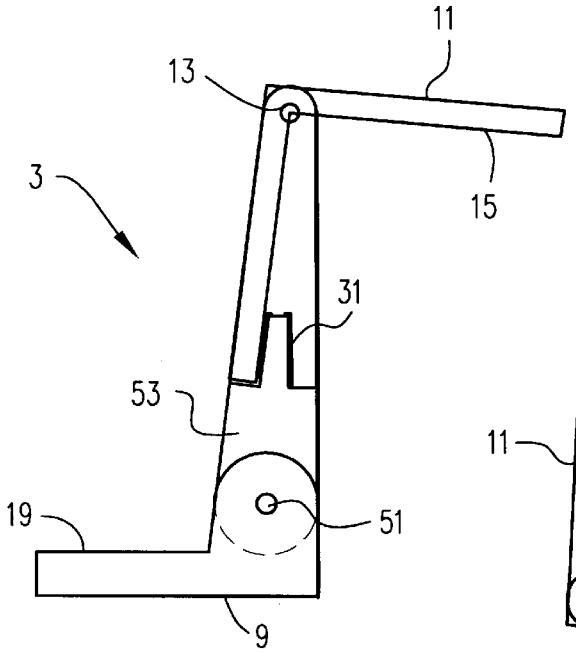

FIG. 25 is a cross-sectional view of the latch assembly of FIG. 24.

Figure 26:
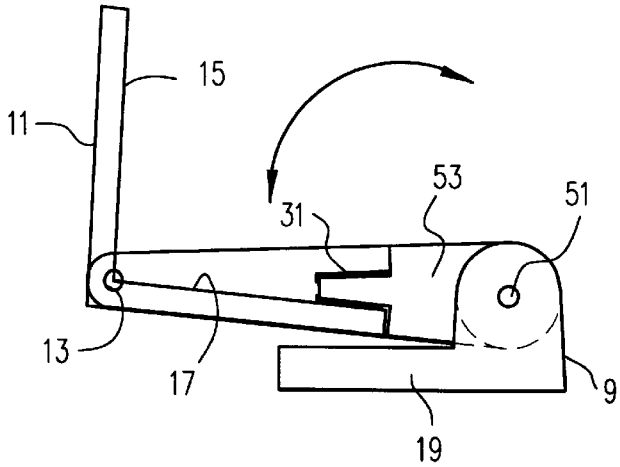

FIG. 26 is a cross-sectional view of the latch assembly of FIGS. 24–25, wherein the latch assembly is shown pivoted to a non-engageable position.

Figure 27:
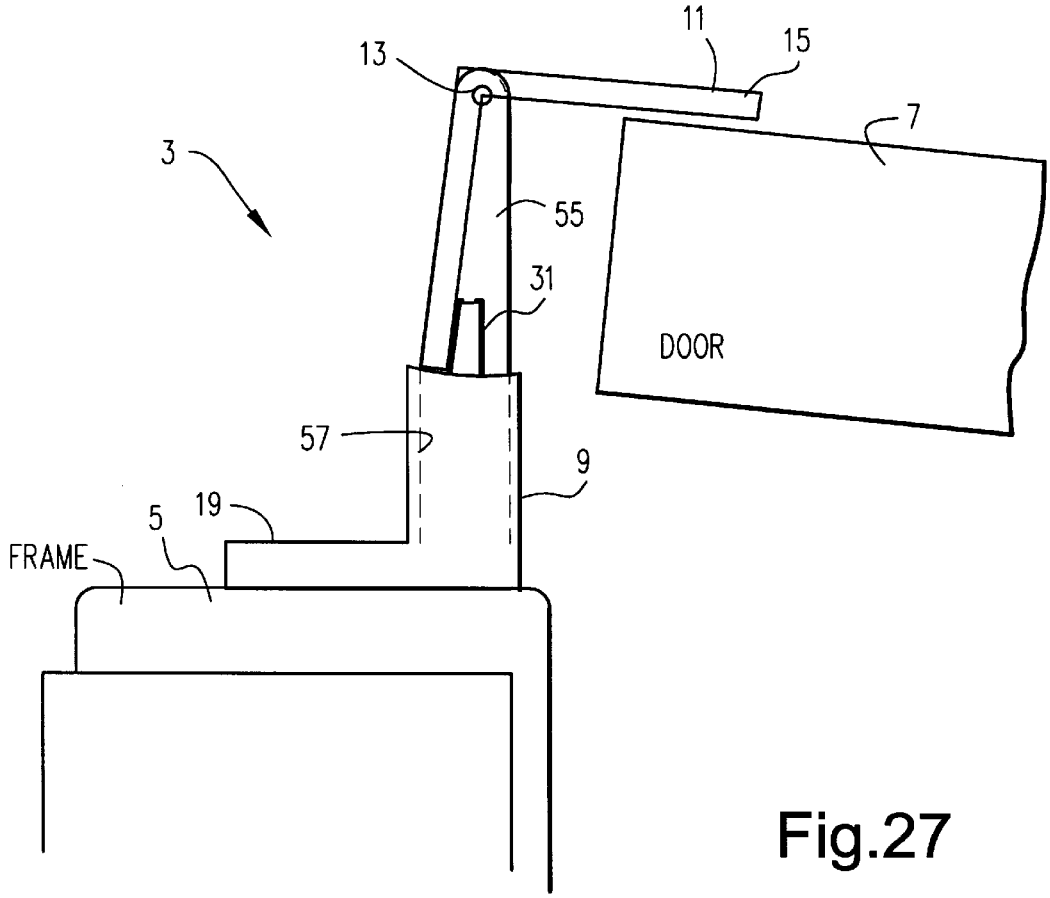

FIG. 27 is a cross-sectional view of a latch assembly according to a third embodiment of this invention, the latch being shown in a locking position.

Figure 28:
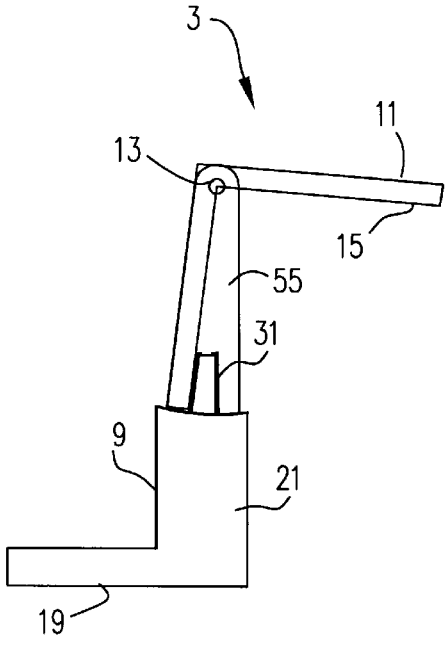

FIG. 28 is a cross-sectional view of the latch assembly of FIG. 27.

Figure 29:
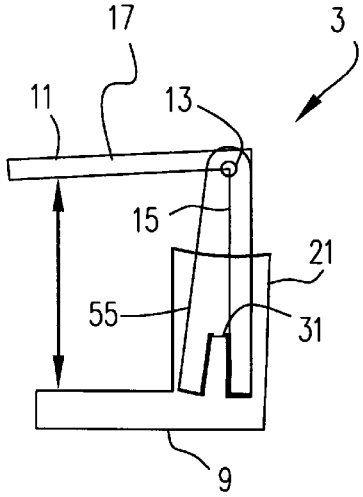

FIG. 29 is a cross-sectional view of the latch assembly of FIGS. 27–28, where the latch is in a retracted position where the L-shaped member cannot be deployed.

Figure 30:
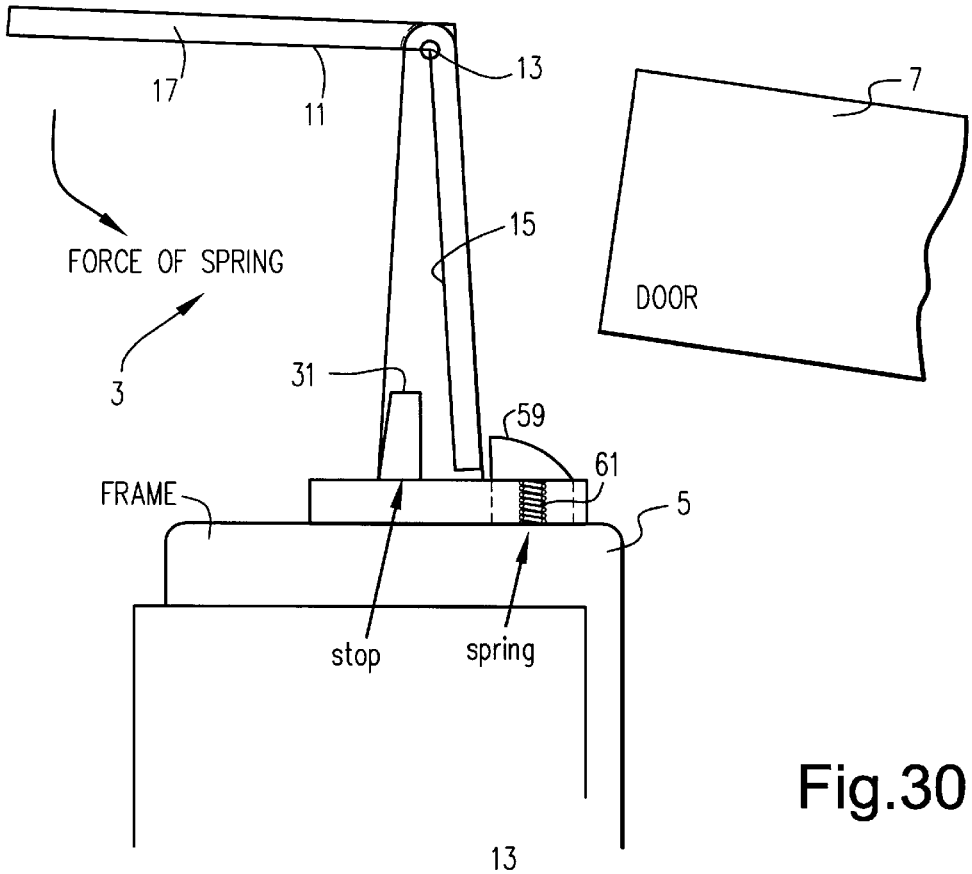

FIG. 30 is a cross-sectional view of a latch assembly according to a fourth embodiment of this invention including a spring biased button, the latch being illustrated in a non-locking position.

Figure 31:
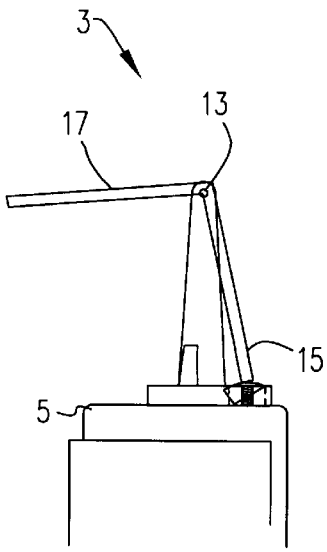

FIG. 31 is a cross-sectional view of the latch assembly of FIG. 30, where the latch is shown being moved between a on-locking and a locking position.

Figure 32:
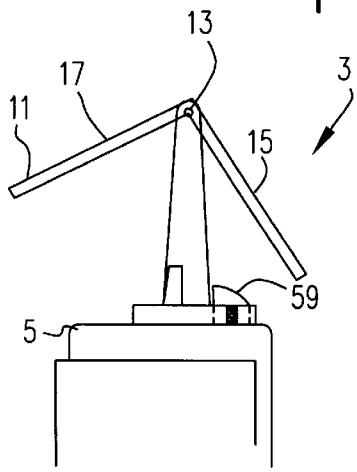

FIG. 32 is a cross-sectional view of the latch assembly of FIGS. 30–31, wherein the latch is shown at a mid-point between locking and non-locking positions.

Figure 33:
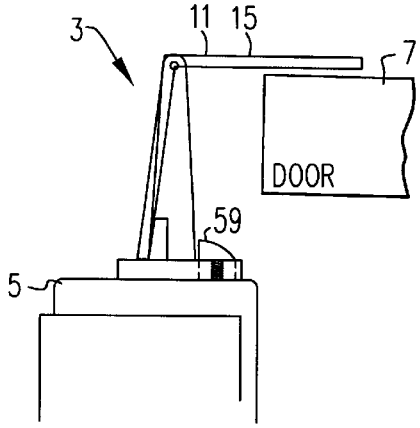

FIG. 33 is a cross-sectional view of the latch assembly of FIGS. 30–32, where the latch is illustrated in a locking position.

Figure 34:
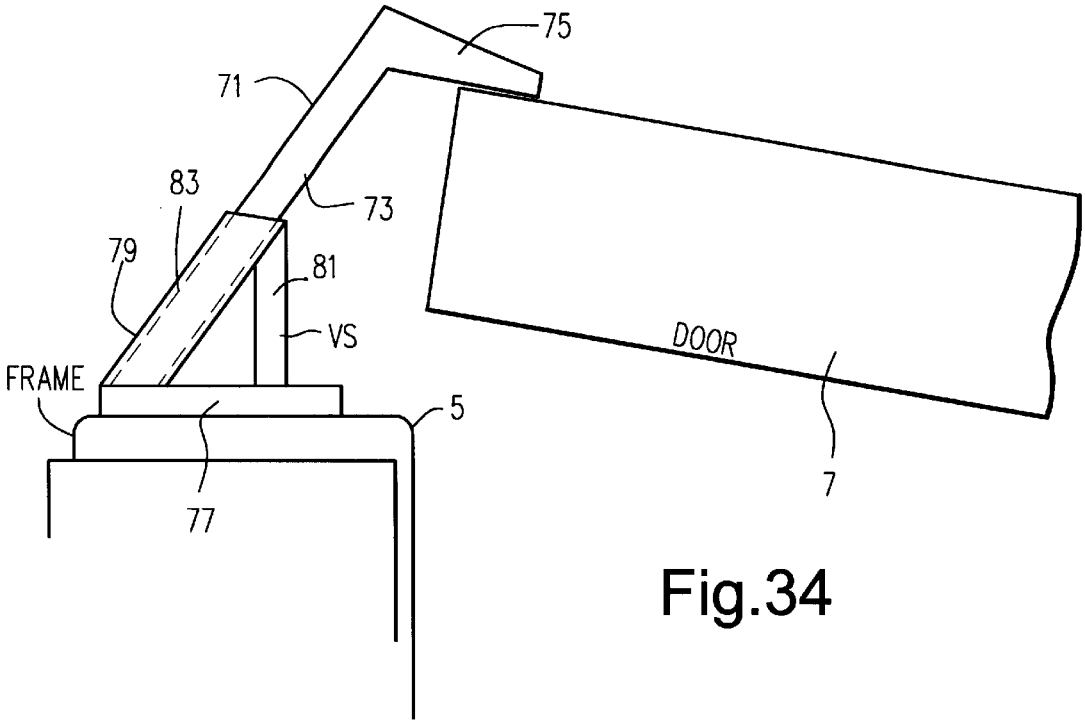

FIG. 34 is a top plan view of a latch assembly according to a fifth embodiment of this invention, the latch being illustrated in a locking or deployed position.

Figure 35:
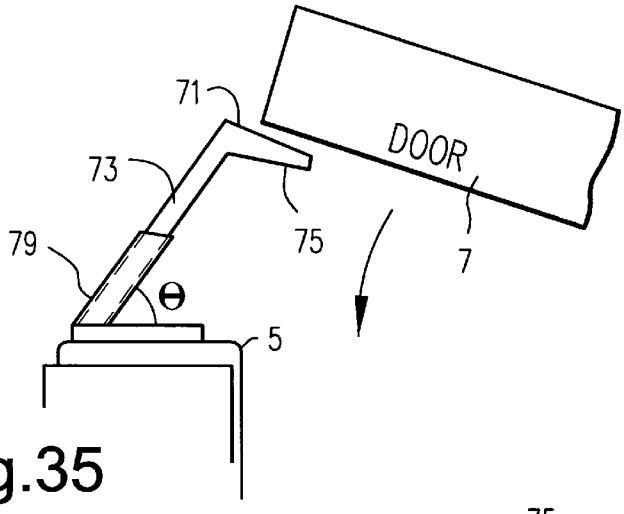

FIG. 35 is a top plan view of the latch assembly of FIG. 34, illustrating a door being closed onto the latch.

Figure 36:
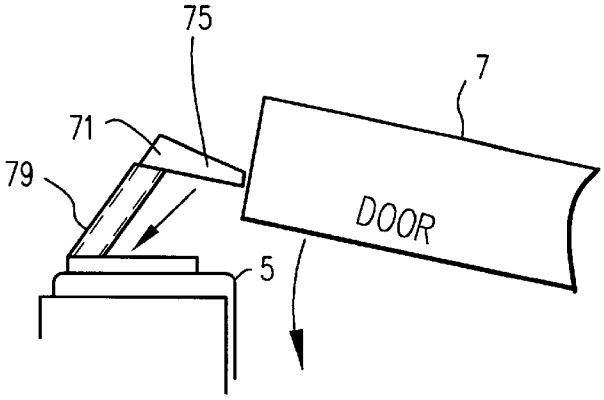

FIG. 36 is a top plan view of the latch assembly of FIGS. 34–35, wherein a door is illustrated as closing onto the latch thereby moving the latch from a locking position into a non-locking position in a telescoping manner.

DETAILED DESCRIPTION OF CERTAIN EMBODIMENTS OF THIS INVENTION

Referring now more particularly to the accompanying drawings in which like reference numerals indicate like parts throughout the several views.

Figure 1:
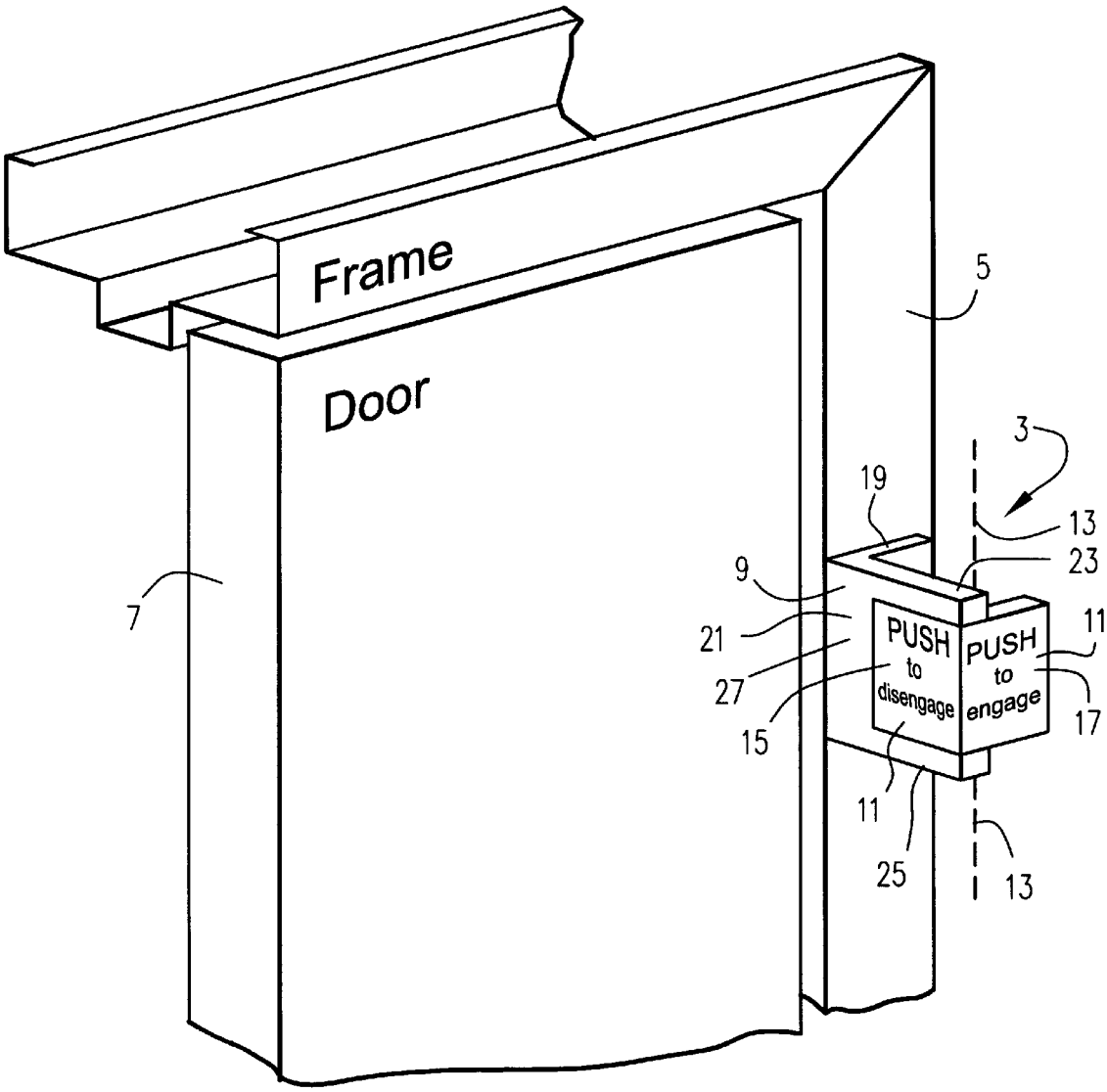
FIG. 1 is a perspective view of a door latch assembly according to a first embodiment of this invention, the latch provided in a non-locking position when the door is closed.

FIG. 1 is a perspective view of latch assembly 3 mounted to door frame 5. Frame 5 houses pivotally mounted door 7 in a door opening. Latch assembly 3 may be provided on the interior side of frame 5, so as to be located within a hotel room, apartment, or other dwelling that door 7 opens into.

As shown, door latch assembly 3 includes approximately L-shaped support bracket 9 that is rigidly mounted to an interior surface of frame 5. Latch assembly 3 further includes approximately L-shaped latch 11 that is pivotally mounted to support bracket 9 by way of vertically aligned pivot axis 13. This pivotal connection between latch 11 and support bracket 9 enables latch 11 to pivot about axis 13 between locking and non-locking positions. In certain embodiments, the range of pivoting motion of latch 11 about axis 13 is from about 70 to 110 degrees, more preferably from about 80 to 100 degrees, and most preferably about 90 degrees. FIG. 1 illustrates latch 11 in a non-locking (i.e. non-engaged) position, so that door 7 may be opened and closed without interference from the latch assembly.

Figure 2:
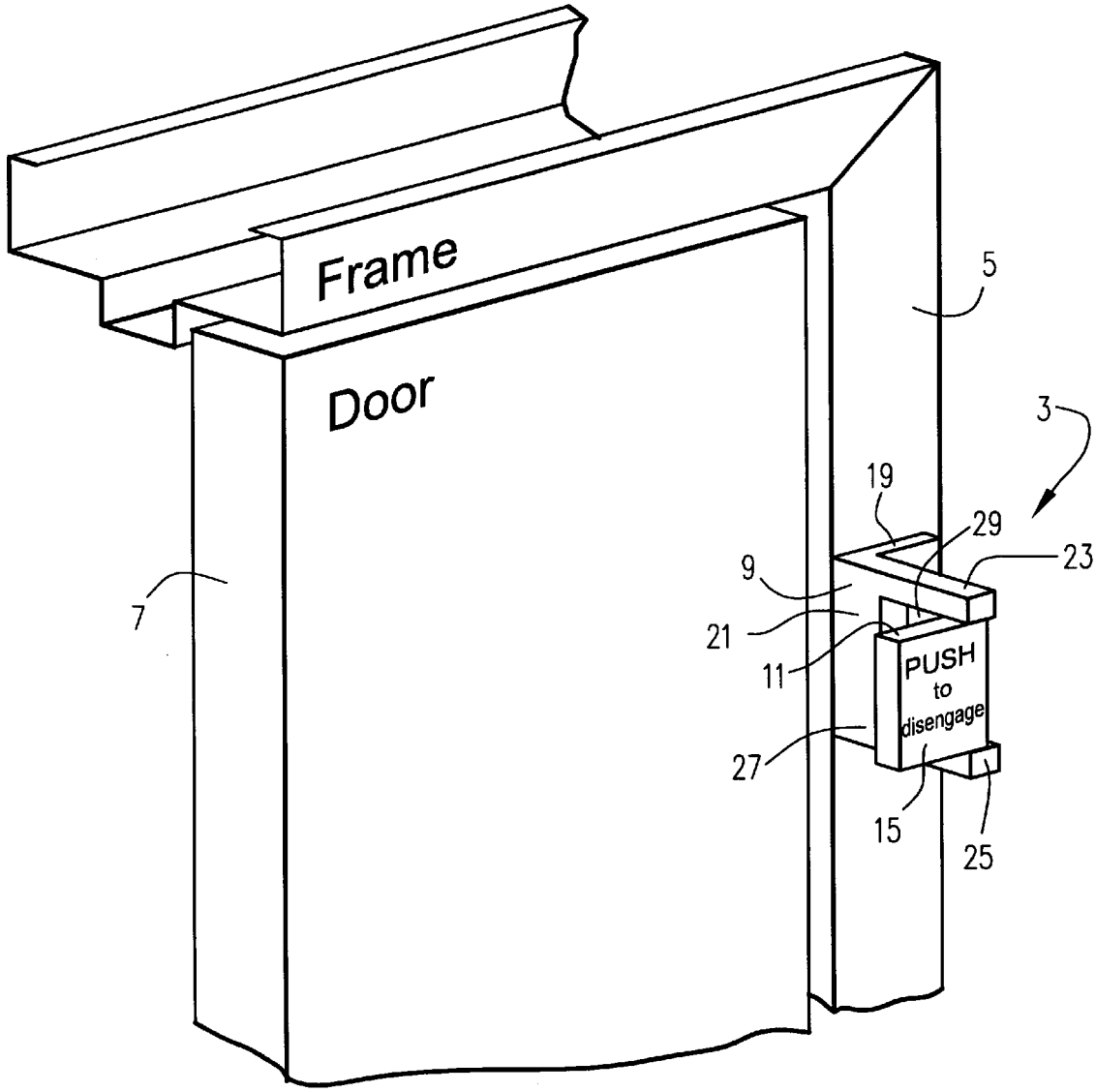
FIG. 2 is a perspective view of the latch assembly of FIG. 1, wherein the latch is in a locking position and the door is closed.
Figure 3:
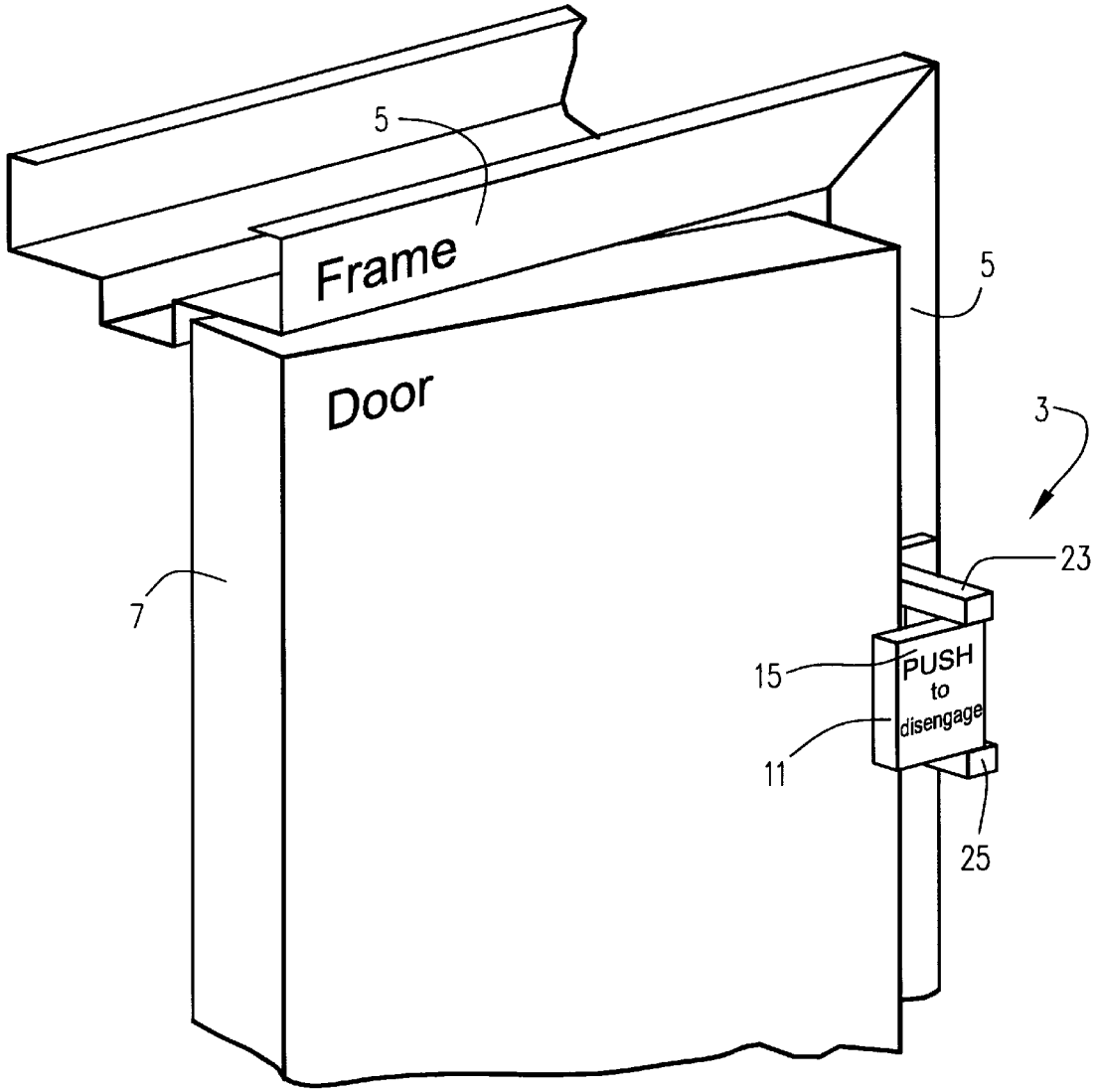
FIG. 3 is a perspective view of the latch assembly of FIGS. 1–2, wherein the latch is in a locking position (i.e engaged position) thereby preventing the door from opening more than a small amount.
Figure 4:
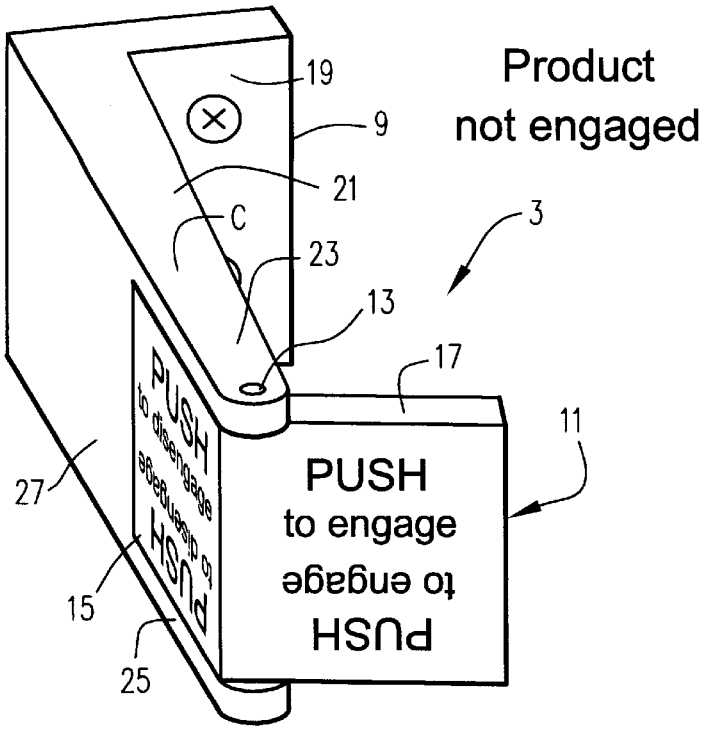
FIG. 4 is an enlarged perspective view of the latch assembly of FIGS. 1–3, where the latch is in a non-locking (i.e. not engaged) position.
Figure 5:
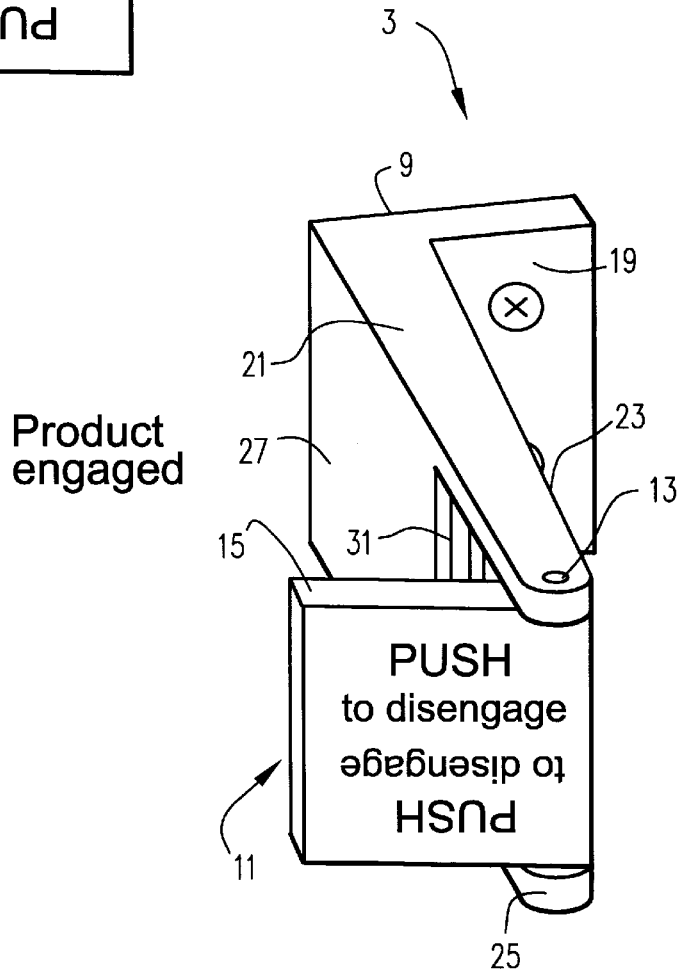
FIG. 5 is an enlarged perspective view of the latch assembly of FIGS. 1–4, where the latch is in a locking (i.e. engaged) position.

FIG. 2 illustrates latch assembly 3, where latch 11 has been pivoted to a locking or engaged position. In a similar manner, FIG. 3 illustrates latch 11 in a locking or engaged position, where door 7 is prevented from fully opening (although it is allowed to crack) by latch 11. FIGS. 4–5 are perspective views of latch assembly 3, with FIG. 4 showing latch 11 in a non-locking position and FIG. 5 showing latch 11 in an engaged or locking position.

Referring to FIGS. 1–5, approximately L-shaped latch 11 includes first approximately planar portion 15 and second approximately planar portion 17 that are oriented approximately perpendicular to one another. The phrase "approximately perpendicular" herein means perpendicular ± about 15°. Support bracket 9 includes first approximately planar mounting portion 19 and portion 21 which are aligned approximately perpendicular to one another. Mounting portion 19 is affixed to, and approximately parallel to, an interior surface of frame 5. Meanwhile, latch supporting portion 21 of bracket 9 includes first and second approximately parallel legs 23 and 25 which extend from base 27. Pivot axis 13 extends between distal ends of legs 23 and 25. Latch 11 is mounted between legs 23 and 25, as the legs define an opening 29 therebetween. Legs 23 and 25, together with base 27, define an approximately U-shaped structure within which latch 11 swings. While latch 11 is approximately L-shaped, support 9 is approximately L-shaped, and portion 21 defines an approximately U-shaped opening, these shapes are provided in preferred embodiments and are not intended to be limiting. Any suitable other shapes may be provided for latch 11, support 9, and/or portion 21 of support 9 provided that a purpose and an object of the instant invention is/are still fulfilled.

Still referring to FIGS. 1–5, latch assembly 3 may operate as follows in certain preferred embodiments. When an occupant enters a hotel room or the like, and shuts the door after entering the room, latch 11 is initially in a non-locking position as shown in FIGS. 1 and 4. The occupant of the room/dwelling may then push portion 17 of latch 11 in order to cause the latch to rotate or pivot approximately 90 degrees about vertical axis 13 so as to move from a non-locking position into the locking position of FIGS. 2–3 and 5. Once latch 11 is in this locking (i.e. engaged) position, it functions to prevent door 7 from opening enough to allow one to enter the room/dwelling. FIG. 3 illustrates one attempting to open door 7 when latch 11 in a locking position; where cracked open door 7 contacts the inner approximately planar surface of portion 15 and is prevented from further opening. Latch 11 prevents further opening of door 7, because stop or abutment 31 (see FIGS. 7–8) prevents portion 17 of the latch from rotating past legs 23, 25, thereby also preventing an opening door 7 from moving portion 15 further than its position shown in FIG. 3.

When latch 11 is in a locking position and door 7 is closed, as shown in FIG. 2, the latch is movable to a non-locking position by an occupant of the room/dwelling simply pushing portion 15 of a latch so as to cause the latch to pivot about axis 13 into the non-locking position of FIGS. 1 and 4. Thus, latch 11 is selectively moveable between locking and non-locking positions, as it may be pivoted about axis 13.

Figure 6:
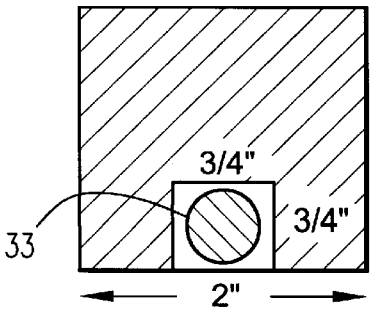
FIG. 6 is a top cross-sectional view of a latch supporting portion, illustrating a magnet provided therein.

In certain preferred embodiments, latch 11 is made of steel, iron, aluminum, or the like. Support bracket 9 may be made of wood, plastic, steel, iron, aluminum, or the like. In certain non-stop inclusive embodiments, magnet 33 as shown in FIG. 6 may be provided in either latch 11 or support 9 for the purpose of maintaining either one of portions 15 and/or 17 in a position between legs 23 and 25. Such a magnet may function to keep latch 11 from freely swinging about within its approximate 90° range.

Figure 7:
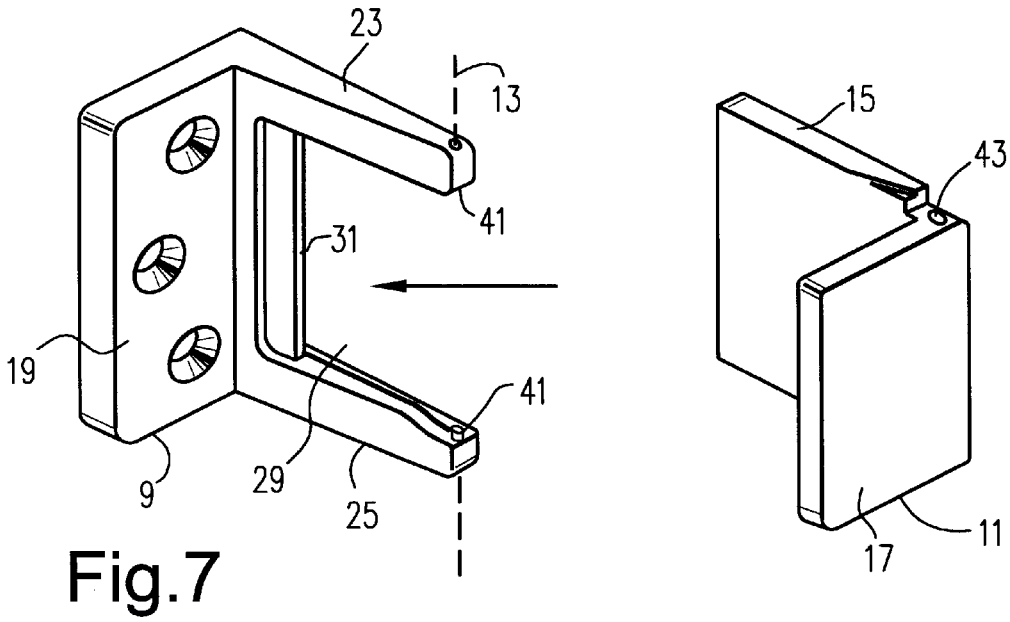
FIG. 7 is an exploded perspective view of the latch assembly of FIGS. 1–5.
Figure 8:
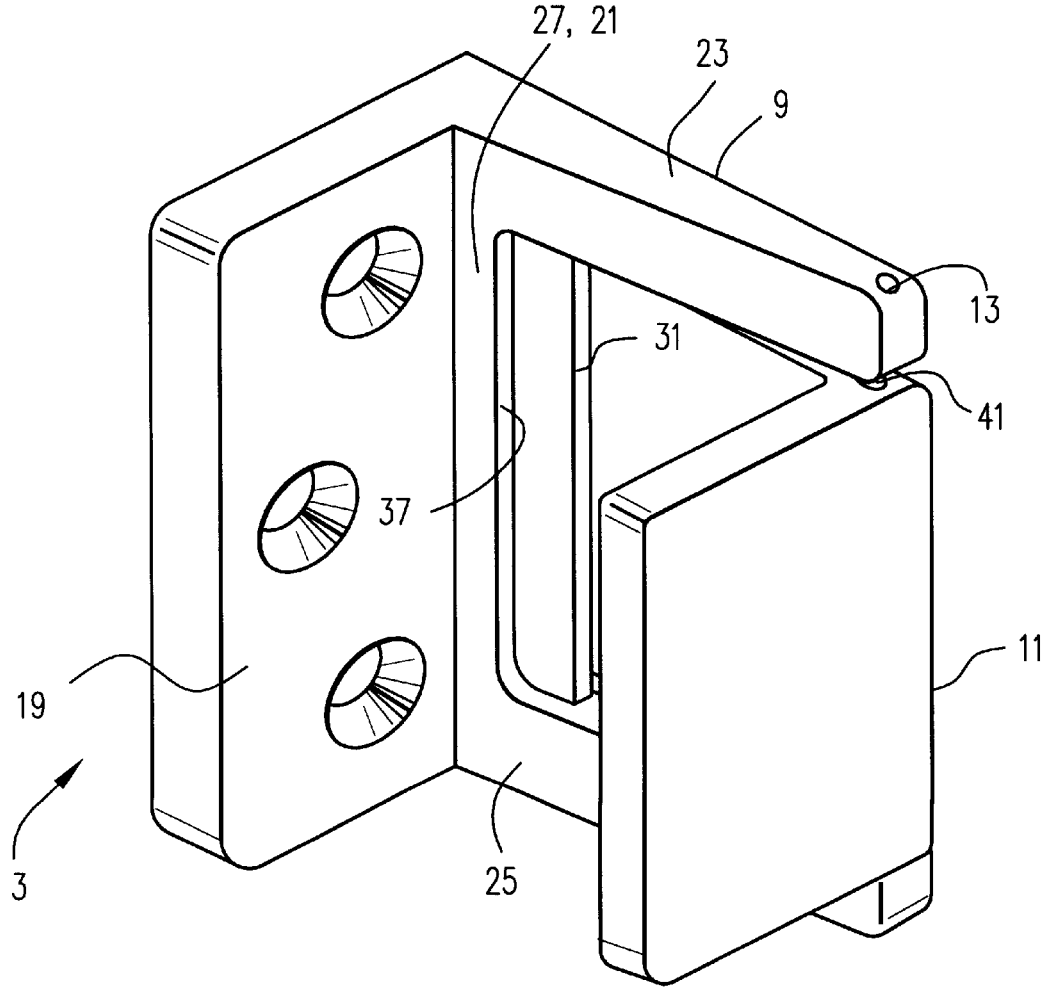
FIG. 8 is an enlarged perspective view of the latch assembly of FIGS. 1–5 and 7.

FIGS. 7–8 illustrate latch assembly 3 of the FIGS. 1–5 embodiment. FIGS. 7–8 illustrate the assembly in an inverted position, for purposes of simplicity. Mounting portion 19 includes a plurality of apertures therein for allowing bolts or screws to affix bracket 9 to frame 5 or a wall adjacent the door opening. Stop 31 is illustrated as protruding from base 21 into opening 29 provided between legs 23, 25. Stop 31 functions to limit the range of rotation or pivoting of latch 11 to approximately 90° in preferred embodiments, as a function of the angle between portions 15 and 17). In other words, stop 31 prevents either portion 15, 17 from rotating all the way through space 29 between legs 23, 25. Stop 31 is preferably centrally located within space 29 so as to provide a step 37 on either side thereof between the legs. Steps 37 enable portions 15, 17 of latch 11, when resting against the stop, to be approximately flush with the adjacent surface of member 9. In alternative embodiments, stop 31 may be non-centrally located within space 29, so that portion(s) 15 and/or 17 are not flush with adjacent surfaces of bracket 9 when the latch is in a locking or a non-locking position.

As shown in FIGS. 7–8, axially aligned pins 41 are provided on member 9, one on the interior surface of each leg 23, 25. The axes of pins 41 define latch pivot axis 13. Pins 41 protrude into respective female apertures 43 defined in latch 11 proximate the intersection of portions 15 and 17, so as to allow the latch to pivot.

FIGS. 9–10 illustrate another aspect of this invention, wherein latch assembly 3 cannot readily be used to prop open door 7 (e.g. when an occupant leaves the room/dwelling). This is because if latch 11 is left in a locking position with the door open (see FIG. 9), a closing action of the door which contacts latch 11 will force the latch to pivot from a locking toward and into a non-locking position thereby allowing the door to close. A door is shown in FIGS. 9–10 doing just this to the latch. In FIG. 9, a closing door contacts the outer surface of portion 15 of latch 11. As the door continues to close, the closing force of the door causes latch 11 to pivot clockwise about axis 13 into a non-locking position thereby allowing door 7 to continue closing during latch rotation, as shown in FIG. 10.

FIGS. 11(*a*)–11(*c*) illustrate latch 11 moving from a locking position to a non-locking position. Such movement may be caused either by a door closing upon the latch as shown in FIGS. 9–10, or alternatively by an occupant of the room/dwelling pushing portion 15 inwardly. The latch begins in a locking position as shown in FIG. 11(*a*). When either an occupant or a door contacts the outer surface of portion 15, and applies inward pressure, latch 11 begins to pivot clockwise about axis 13 as shown in FIG. 11(*b*). This clockwise rotation/pivoting continues until latch 11 reaches a non-locking position and the inner surface of portion 15 contacts and is halted by stop 31 in the non-locking position shown in FIG. 11(*c*).

FIGS. 12(*a*) and 12(*b*) are top views illustrating an embodiment of this invention wherein a magnet 32 is provided within or as stop 31 for the purpose of maintaining latch 11 in either a locking or a non-locking position. When either portion 15 or portion 17 of metallic latch 11 is proximate magnet 31, a magnetic force from magnet 32 attracts the distal end of such latch portion to the magnet/stop thereby maintaining the latch in either a non-locking (FIG. 12(*a*)) or a locking (FIG. 12(*b*)) position. This prevents latch 11 from freely swinging through its 90 degree range, and also causes the latch to be retained in its locking position when one positions the latch in such a manner.

FIGS. 13–14 illustrate latch assembly 3 in a non-locking position so as to permit door 7 to freely open and close via hinge 45. As shown in FIGS. 13–14, latch assembly 3 is preferably rigidly affixed to an interior approximately planar surface of door frame 5. However, in alternative embodiment of this invention, latch assembly 3 may be affixed directly to an interior surface of the wall, or even to the interior surface of door 7 proximate the door/frame interface.

FIGS. 15–16 illustrate the latch assembly of FIGS. 1–5 and 7–14 in a non-locking position, and door 7 being freely swingable into and out of the door opening past the latch assembly.

FIGS. 17–18 illustrate the latch assembly of FIGS. 1–5 and 7–16 in a locking or engaged position. Portion 15 of approximately L-shaped latch 11 is located within the opening path of door 7. When door 7 contacts the interior surface of portion 15 as shown in FIG. 19, stop 31 prevents latch 11 from further counterclockwise rotation thereby preventing door 7 from further opening. This small or cracked opening of door 7 allows one inside of the room/dwelling to speak to one outside the door, but prevents a person outside from entering the room/dwelling through the doorway. Moreover, wire cutters or the like cannot be used to break or disengage the latch assembly.

FIGS. 21(*a*)–(*d*) illustrate door 7 proceeding from an open position to a closed position, and during the course of such movement contacting and causing latch 11 to pivot from a locking position shown in FIG. 21(*a*) to a non-locking position shown in FIG. 21(*d*). FIGS. 21(*b*) and 21(*c*) are mid-point locations during the door closing process, with the 21(*b*) position occurring prior to the 21(*c*) position.

FIGS. 22–23 illustrate a process which may be utilized to disengage latch assembly 3 in emergency situations. For example, if one becomes passed out or disabled within a hotel room/dwelling, and entry thereinto is prevented by latch assembly 3, the emergency opening process shown in FIGS. 22–23 may be utilized. First, as shown in FIG. 23, door 7 is slightly opened so as to abut latch 11, and one outside of the door throws hook 47 around a top portion of latch portion 15. Hook 47 is attached to an end of string 49. After hooking, door 7 is closed to the position shown in FIG. 22 so that the string is provided through the slit between the closed door and adjacent frame. One then pulls on string 49 when the door is closed, thereby causing latch 11 to pivot about axis 13 from its FIG. 22 locking position to a non-locking position where portion 15 rests against stop 31. Door 7 can then be opened to gain access to the room/dwelling.

FIGS. 24–26 illustrate a latch assembly according to another embodiment of this invention. According to this embodiment, support bracket 9 includes a hinge or pivot member defining approximately vertical pivot axis 51 between different portions of support bracket 9. FIG. 24 illustrates latch 11 in a locking position for preventing door 7 from further opening. As in all embodiments herein, when door 7 is in a partially opened position as shown in FIG. 24, the door itself prevents latch 11 from being rotated clockwise from its locking to a non-locking position. FIG. 25 also illustrates the latch assembly of FIG. 24 in a locking position. Latch 11 of this embodiment may be pivoted from its locking to a non-locking position in a manner similar to that described above with regard to previous embodiments. However, pivot axis 51 allows the latch assembly to be disengaged (or engaged) in yet another manner. As shown in FIG. 26, the latch assembly may be disengaged without moving latch 11 about axis 13. To do this, support bracket portion 53 along with latch 11 attached thereto are rotated or pivoted approximately 90° about axis 51 from the FIG. 25 locking position to the non-locking FIG. 26 position. When portion 53 is in the FIG. 26 position, latch 11 cannot be engaged regardless of whether it is pivoted about axis 13.

FIGS. 27–29 illustrate a latch assembly according to yet another embodiment of this invention. This embodiment includes a telescoping feature wherein latch 11 and support legs portion 55 (including legs 23, 25) can be axially moved between a retracted FIG. 29 position and an extended FIGS. 27–28 position, in a telescoping manner. In the retracted position shown in FIG. 29, a substantial portion of support 55, legs 23, 25, and portion 15 of the latch are located within a hollow recess or channel 57 defined in portion 21. When in the FIG. 29 position, latch 11 cannot be substantially pivoted about axis 13, because stop 31 prevents such pivoting in one direction while the sidewall of the recess prevents pivoting in the other direction. To move latch 11 from its non-locking FIG. 29 position, support 55 and latch 11 are pulled outwardly in an axial manner from recess 57, so that latch 11 becomes completely located outside of the recess. Once outside of the recess, latch 11 can be pivoted about axis 13 so as to cause portion 15 to rotate approximately 90° to the FIGS. 27–28 locking position.

FIGS. 30–33 illustrate still another embodiment of this invention, where stop 31 is located off-center between legs 23, 25. Additionally, spring loaded button 59 is provided for retaining latch 11 in the FIG. 30 non-locking position. Spring 61 normally biases button 59 toward the position shown in FIG. 30, where the button prevents latch 11 from pivoting in one direction while stop 31 prevents the latch from pivoting in the other direction. This structure allows the latch to be retained or maintained in a non-locking position. When it is desired to move the latch to a locking position, a user presses button 59 downwardly against the force of spring 61 with his/her finger and simultaneously pushes latch portion 17 so as to cause the latch to rotate about axis 13 with portion 15 proceeding past the depressed button as shown in FIGS. 31 and 32. The button is released after portion 15 pivots past it. Continuing pivoting of latch 11 results in the latch reaching its locking position shown in FIG. 33, where portion 17 of the latch rests against stop 31 and is prevent from further counterclockwise pivoting/rotating. As in all other embodiments herein, the stop 31 may be of or include a magnet that creates a magnetic force for keeping portion 17 biased against the stop when the latch is in the locking position.

FIGS. 34–36 illustrate a door latching assembly according to another embodiment of this invention. In this embodiment, the latch assembly includes a support bracket rigidly affixed to frame 5, and locking member 71 slidably receivable therein in an axial manner. Locking member 71 includes a first elongated portion 73 and contact portion 75. Portion 73 and 75 define an angle of approximately 90°–150° relative to one another, preferably an angle of from about 100°–130° relative to one another. The support bracket includes base portion 77 rigidly affixed to frame 5, elongated hollow tubular support member 79 for selectively receiving portion 73, and support member 81 extending between base 77 and tubular support member 79. Member 79 includes a channel 83 defined therein within which elongated portion 73 may is slideably received. In certain embodiments, support member 79 defines an angle θ with base 77 of from about 35 to 80 degrees, more preferably from bout 40 to 60 degrees, and most preferably from about 45 to 55 degrees. FIG. 34 illustrates the latch assembly in a locking position, while FIG. 36 illustrates the latching assembly in a non-locking position. When door 7 contacts locking portion 75, member 71 is prevented from further movement outwardly from channel 83 by an unillustrated keyway engaging stop within the interior of member 79, and thus door 7 cannot be opened any further. Member 71 may be maintained in the locking position by a magnetic biasing force or the like. This effectively locks the door against unlawful entry, as with all other embodiments herein. Like other embodiments herein, the FIGS. 34–36 embodiment cannot be utilized to easily prop open a door when an occupant leaves the room. As shown in FIGS. 35–36, when door 7 closes upon and contacts the outer surface of locking portion 75 when it is in a locking position, the continuing closing movement of the door causes member 71 to move linearly into channel 83 thereby causing locking portion 75 to move out of the closing path of door 7. Thus, as with other embodiments herein, closing of door 7 on a latch assembly in a locking position causes the latching assembly to move into a non-locking position as the door is closed.

Once given the above disclosure, many other features, modifications, and improvements will become apparent to the skilled artisan. Such other features, modifications, and improvements are, therefore, considered to be a part of this invention, the scope of which is to be determined by the following claims.

I claim:

1. A door latch assembly comprising:

an approximately L-shaped support member rigidly secured to an interior surface of a door frame, said support member including first and second approximately parallel legs extending from a base portion so as to define an opening between said legs;

an approximately L-shaped latch pivotally connected to said support member between said legs, said latch pivoting about a pivot axis; and wherein said latch is pivotal about said pivot axis between a locking position that allows the door to be only opened partially and a non-locking position.

2. The door latch of claim 1, wherein said latch is pivotal about said pivot axis through a range of from about 80 to 100 degrees.

3. The door latch of claim 1, further including means for enabling a door closing upon said latch to cause said latch to pivot from the locking position to a non-locking position.

4. The door latch assembly of claim 1, wherein said latch and said pivot axis are located relative to said door frame and one another so that when a door mounted on said door frame closes a surface of said door contacts said latch and causes said latch to pivot from the locking position to the non-locking position such that closing of said door automatically causes said latch to pivot from the locking position to the non-locking position.

5. The door latch of claim 1, wherein said support member includes a support pivot axis and said support member includes two separate portions pivotal relative to one another about said support pivot axis.

6. The door latch of claim 1, further comprising a spring-biased button for retaining said latch in a non-locking position.

7. A door latch assembly comprising:

a support member rigidly secured to an interior surface of a door frame said support member including a hollow portion having an elongated cavity defined therein;

said elongated cavity secured to said door frame surface so as to define an angle θ of from about 35 to 80 degrees with the door frame surface;

a latch including first and second portions oriented relative to one another at an angle of from about 90 to 150 degrees;

wherein said first portion of said latch is contacted by a door in order to prevent the door from fully opening and said portion of said latch is slideably received within said elongated cavity so that said latch is slideable between door locking and non-locking positions; and wherein at least a portion of said latch is slideably mounted in said elongated cavity in a manner such that when the door closes a surface of said door contacts said first portion of said latch and causes said second portion of said latch to slide inwardly in said cavity until said latch is in the non-locking position, so that closing of said door automatically causes said latch to slide from the locking position to the non-locking position.

8. A door latch assembly adapted to be connected to an interior surface of a door frame, the door latch assembly comprising:

an approximately L-shaped support member adapted to be rigidly affixed to the door frame, said support member including first and second approximately parallel legs extending from a base portion so as to define an opening between said legs;

an approximately L-shaped latch pivotally connected to said support member between said legs, said latch pivoting about a pivot axis;

wherein said latch is pivotal about said pivot axis between a locking position and a non-locking position;

a stop extending from said base and being located between said legs, wherein said stop prevents said latch from pivoting more than about 100 degrees; and wherein said stop comprises a magnet, and said latch includes metallic material.

9. The door latch of claim 8, wherein said support member include a plurality of apertures defined therein so as to enable screws to extend therethrough to secure said support member to the door frame.

10. A door latch assembly adapted to be connected to an interior surface of a door frame, the door latch assembly comprising:

an approximately L-shaped support member adapted to be rigidly affixed to the door frame, said support member including first and second approximately parallel legs extending from a base portion so as to define an opening between said legs;

an approximately L-shaped latch pivotally connected to said support member between said legs, said latch pivoting about a pivot axis;

wherein said latch is pivotal about said pivot axis between a locking position and a non-locking position; and wherein said support member includes a hollow portion and at least a portion of said latch is selectively slideably received within a cavity of said support member to selectively prevent the latch from pivoting.

* * * * *